US010850285B2

(12) United States Patent
Pruitt

(10) Patent No.: US 10,850,285 B2
(45) Date of Patent: Dec. 1, 2020

(54) GARBAGE DISPOSAL ASSEMBLY APPARATUS

(71) Applicant: Anthony Pruitt, Marietta, GA (US)

(72) Inventor: Anthony Pruitt, Marietta, GA (US)

( * ) Notice: Subject to any disclaimer, the term of this patent is extended or adjusted under 35 U.S.C. 154(b) by 0 days.

(21) Appl. No.: 16/401,110

(22) Filed: May 1, 2019

(65) Prior Publication Data

US 2019/0338503 A1 Nov. 7, 2019

Related U.S. Application Data

(60) Provisional application No. 62/762,347, filed on May 1, 2018, provisional application No. 62/750,711, filed on Oct. 25, 2018.

(51) Int. Cl.

| | |
|---|---|
| ***B02C 18/00*** | (2006.01) |
| ***B02C 18/18*** | (2006.01) |
| ***E03C 1/23*** | (2006.01) |

(52) U.S. Cl.

CPC ..... *B02C 18/0092* (2013.01); *B02C 18/0084* (2013.01); *B02C 18/18* (2013.01); *E03C 1/2302* (2013.01); *E03C 2001/2315* (2013.01); *Y10T 29/49897* (2015.01)

(58) Field of Classification Search

CPC ..... E03C 1/2302; E03C 2001/2315; E03C 1/266; Y10T 29/49897; B02C 18/0092; B02C 18/18; B02C 18/0084

See application file for complete search history.

(56) References Cited

U.S. PATENT DOCUMENTS

| | | | | |
|---|---|---|---|---|
| 10,065,299 | B2 * | 9/2018 | Shields | E03C 1/266 |
| 2007/0000116 | A1 * | 1/2007 | Goldburt | E03C 1/2665 29/464 |
| 2008/0178455 | A1 * | 7/2008 | Cox | E03C 1/266 29/464 |
| 2014/0110557 | A1 * | 4/2014 | Dines | F16M 13/02 248/637 |
| 2018/0178360 | A1 * | 6/2018 | Shields | B02C 18/0092 |

* cited by examiner

*Primary Examiner* — Bayan Salone
(74) *Attorney, Agent, or Firm* — Thomas E. LaGrandeur; Bold IP, PLLC

(57) ABSTRACT

Implementations of a garbage disposal assembly apparatus are provided. In some implementations, the garbage disposal assembly apparatus comprises a top part, an elongated member, a handle, and a support member.

In some implementations, a method of using the garbage disposal assembly apparatus comprises installing a garbage disposal assembly to a sink using the garbage disposal assembly apparatus.

13 Claims, 11 Drawing Sheets

GARBAGE DISPOSAL ASSEMBLY APPARATUS

CROSS REFERENCE TO RELATED APPLICATION

This application claims the benefit of U.S. Patent Application Ser. No. 62/762,347, which was filed on May 1, 2018, and of U.S. Patent Application Ser. No. 62/750,711, which was filed on Oct. 25, 2018, each of which is incorporated herein by reference in its entirety.

TECHNICAL FIELD

This disclosure relates to implementations of a garbage disposal assembly apparatus.

BACKGROUND

Garbage disposals, sometimes also known as garbage disposers or garbage disposal units, are very popular to install for use on sinks in many applications, such as home or business kitchens. As shown in FIG. 1, a garbage disposal installation usually includes a sink flange (also known as a top or upper flange), a fiber gasket, a backup flange (also known as a bottom or lower flange), a mounting ring, and a snap ring. These "garbage disposal assembly" components are accordingly combined and attached to the drain opening of a sink. A garbage disposal is attached to the mounting ring of the garbage disposal assembly to complete the installation of the garbage disposal to the sink along with additional connections for drainage, power supply, etc.

As part of the garbage disposal assembly installation, plumber's putty is usually applied to the sink flange for sealing of the sink flange in the sink drain opening. Pressure is applied on top of the sink flange installed in the sink drain opening. The pressure is applied to allow the plumber's putty to form a water-tight seal of the sink flange to the sink. The pressure is also applied to stabilize the sink flange for installation of the other assembly components under the sink. The pressure is usually applied by a weighted object placed in the sink on top of the sink flange. Alternately, the pressure is applied by one installer manually pressing down on the sink flange above the sink while a second installer installs the other assembly components below the sink.

However, such usual ways of applying pressure to the sink flange as part of the garbage disposal installation bring up several problems. For example, an appropriate weighted object may not be readily available for use to apply the pressure. Furthermore, even if available, the weighted object may scratch or otherwise cause damage to the sink when used.

As another example, manually applying the pressure to the sink flange requires an additional installer to perform the garbage disposal installation which could otherwise be performed by one installer. Furthermore, a single installer attempting to apply the pressure manually while performing the installation also brings up problems. For example, it is difficult for a single installer to appropriately handle the other assembly components below the sink while also applying pressure to the sink flange above the sink. Therefore, such installation attempts by a single installer are more likely to cause undesired results such as leaking of the plumber's putty seal between the sink flange and the sink.

Additionally, whether the pressure is applied to the sink flange using a weighted object or manually by an installer, such ways also bring up the problems of too little, too much, and/or uneven pressure being applied. Such problems may also cause undesired results such as leaking of the plumber's putty seal between the sink flange and the sink, damage to the sink, etc.

DETAILED DESCRIPTION

Figure 1:
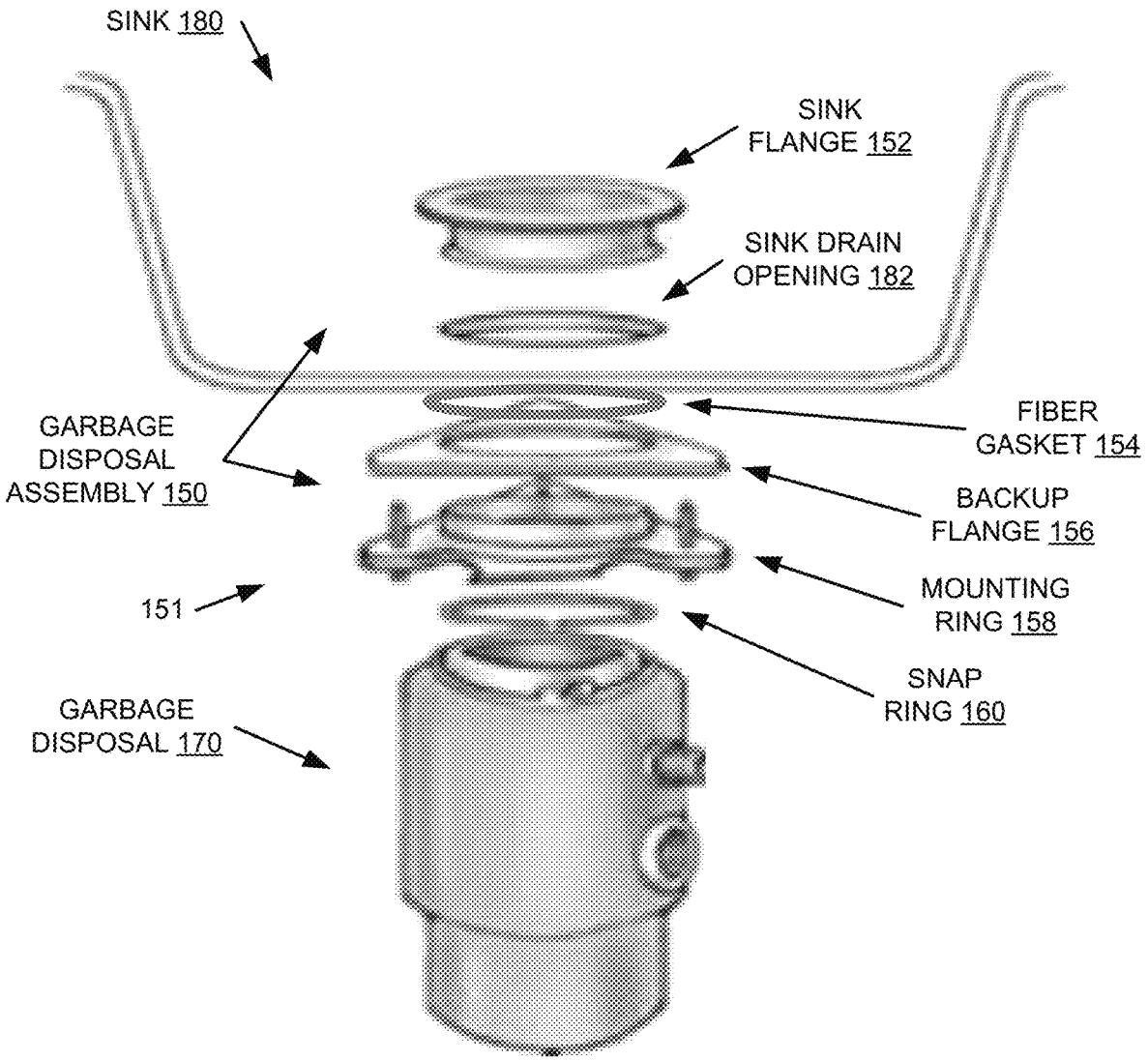
FIG. 1 (PRIOR ART)
FIG. 1 illustrates an exploded view of a garbage disposal assembly installed on a cutaway view of a sink.

Implementations of a garbage disposal assembly apparatus are provided. In some implementations, the garbage disposal assembly apparatus comprises a top part, an elongated member, a handle, and a support member.

In some implementations, the garbage disposal assembly apparatus is configured to hold a sink flange of a garbage disposal assembly firmly in place in a sink drain opening.

In some implementations, the garbage disposal assembly apparatus is configured to apply pressure on top of a sink flange installed in a sink drain opening. In some implementations, the garbage disposal assembly apparatus is configured to apply sufficient, even pressure to the sink flange.

In some implementations, the garbage disposal assembly apparatus is configured to apply pressure to a sink flange for sealing of the sink flange in a sink drain opening.

In some implementations, the garbage disposal assembly apparatus is configured to apply pressure to allow plumber's putty applied to a sink flange to form a water-tight seal of the sink flange to a sink.

In some implementations, the garbage disposal assembly apparatus is configured to apply pressure to a sink flange to stabilize the sink flange for installation of other garbage disposal assembly components to a sink.

In some implementations, the garbage disposal assembly apparatus is configured to apply pressure to a sink flange without the use of a weighted object which may scratch or otherwise cause damage to a sink.

In some implementations, the garbage disposal assembly apparatus is configured to apply pressure to a sink flange without the use of manual pressure applied by an installer.

In some implementations, the garbage disposal assembly apparatus is configured to hold other garbage disposal assembly components under a sink, such as a fiber gasket, a backup flange, a mounting ring, and/or a snap ring. In some implementations, the garbage disposal assembly apparatus is configured to hold the other garbage disposal assembly components under the sink to be installed at the sink drain opening.

In some implementations, the garbage disposal assembly apparatus is configured to apply pressure to a sink flange above a sink so that a second installer is not required to install other garbage disposal assembly components under the sink.

In some implementations, the garbage disposal assembly apparatus is configured to allow a single installer to perform a garbage disposal assembly installation while applying pressure to the sink flange using the garbage disposal assembly apparatus.

In this way, in some implementations, the garbage disposal assembly apparatus eliminates the need to use a weighted object or an additional installer to properly install a garbage disposal assembly to a sink. In some implementations, the garbage disposal assembly apparatus eliminates such need by applying pressure to a sink flange above the sink and holding the other garbage disposal assembly components under the sink.

In some implementations, a method of using the garbage disposal assembly apparatus comprises securely connecting the top part and the elongated member together or securely connecting the handle and the elongated member together.

In some implementations, the method comprises placing or otherwise positioning the top part onto a sink flange that is placed in a sink drain opening as part of a garbage disposal assembly installation.

In some implementations, the method comprises securing the components of the garbage disposal assembly, other than the sink flange, to the garbage disposal assembly apparatus by the elongated member.

In some implementations, the method comprises inserting the elongated member through the support member opening.

In some implementations, the method comprises engagedly connecting the handle to the elongated member or engagedly connecting the elongated member to the top part.

In some implementations, the method comprises moving the handle upward along the elongated member, or moving the elongated member upward through the top part, to engage the support member to the sink bottom and thereby apply downward pressure against the sink flange.

In some implementations, the method further comprises installing the other components of the garbage disposal assembly, in addition to the sink flange, to the sink.

In some implementations, the method further comprises removing the garbage disposal assembly apparatus from the sink after installing the other components of the garbage disposal assembly, in addition to the sink flange, to the sink.

FIG. 1 illustrates an exploded view of a garbage disposal assembly 150 installed on a cutaway view of a sink 180. Garbage disposals 170, sometimes also known as garbage disposers or garbage disposal units, are very popular to install for use on sinks 180 in many applications, such as home or business kitchens (i.e., a kitchen sink).

A garbage disposal assembly 150 usually includes a sink flange (also known as a top or upper flange) 152, a fiber gasket 154, a backup flange (also known as a bottom or lower flange) 156, a mounting ring 158, and a snap ring 160. These garbage disposal assembly 150 components are accordingly combined and attached to the drain opening of a sink 180. A garbage disposal 170 is attached to the mounting ring 158 of the garbage disposal assembly 150 to complete the installation of the garbage disposal 170 to the sink 180 along with additional connections (not shown) for drainage, power supply, etc.

As discussed further below, a subset (or "other garbage disposal assembly components") 151 of the garbage disposal assembly 150 components may include the fiber gasket 154, the backup flange 156, the mounting ring 158, and/or the snap ring 160.

As part of the garbage disposal assembly 150 installation, plumber's putty is usually applied to the sink flange 152 for sealing of the sink flange 152 in the sink drain opening 182. Pressure is applied on top of the sink flange 152 installed in the sink drain opening 182. The pressure is applied to allow the plumber's putty to form a water-tight seal of the sink flange 152 to the sink 180. The pressure is also applied to stabilize the sink flange 152 for installation of the other assembly 150 components under the sink 180. The pressure is usually applied by a weighted object (not shown) placed in the sink 180 on top of the sink flange 152. Alternately, the pressure is applied by one installer manually pressing down on the sink flange 152 above the sink 180 while a second installer installs the other assembly 150 components below the sink 180.

However, such usual ways of applying pressure to the sink flange 152 as part of the garbage disposal assembly 150 installation bring up several problems. For example, an appropriate weighted object may not be readily available for use to apply the pressure. Furthermore, even if available, the weighted object may scratch or otherwise cause damage to the sink 180 when used.

As another example, manually applying the pressure to the sink flange 152 requires an additional installer to perform the garbage disposal assembly 150 installation which could otherwise be performed by one installer. Furthermore, a single installer attempting to apply the pressure manually while performing the garbage disposal assembly 150 installation also brings up problems. For example, it is difficult for a single installer to appropriately handle the other assembly 150 components below the sink 180 while also applying pressure to the sink flange 152 above the sink 180. Therefore, such installation attempts by a single installer are more likely to cause undesired results such as leaking of the plumber's putty seal (not shown) between the sink flange 152 and the sink 180.

Additionally, whether the pressure is applied to the sink flange 152 using a weighted object or manually by an installer, such ways also bring up the problems of too little, too much, and/or uneven pressure being applied. Such problems may also cause undesired results such as leaking of the plumber's putty seal between the sink flange 152 and the sink 180, damage to the sink 180, etc.

Figure 4:
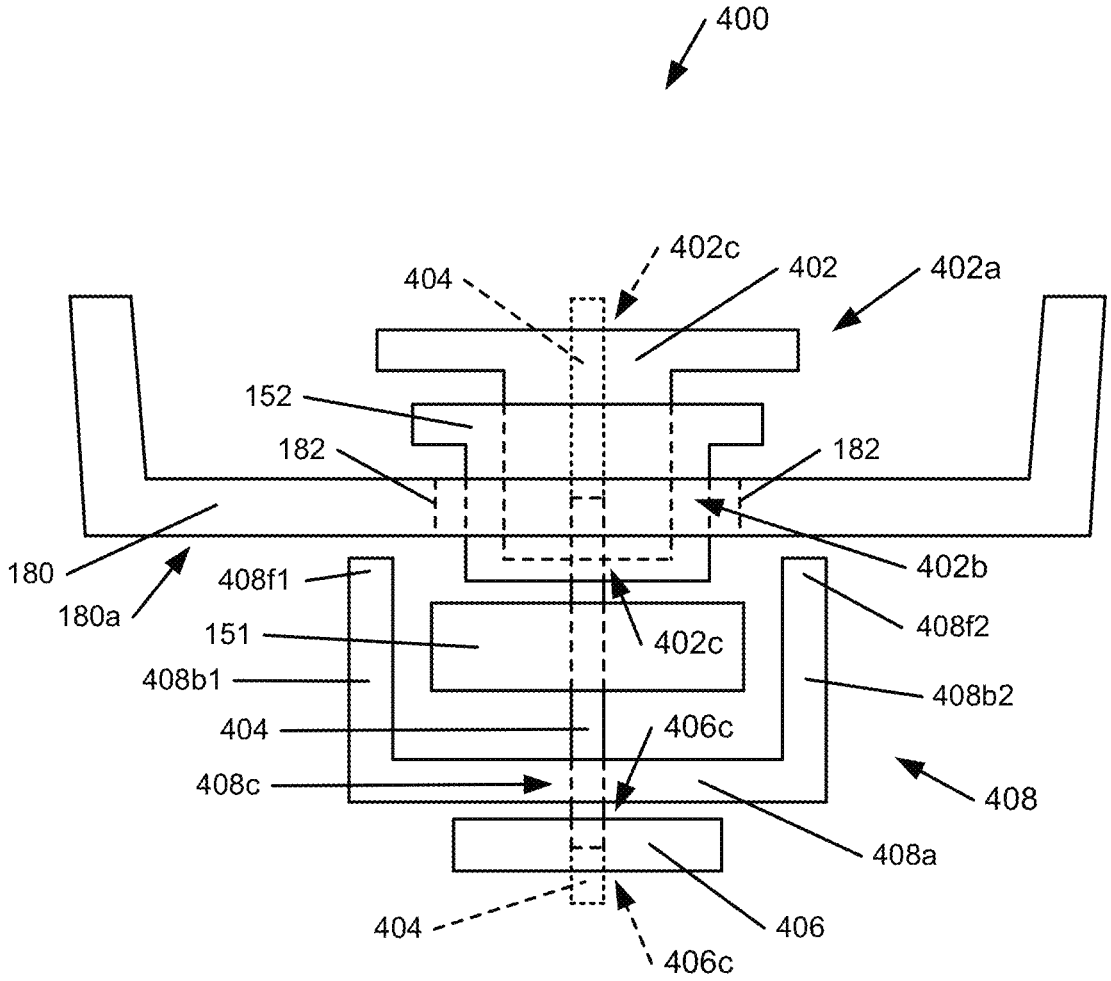
FIG. 4 illustrates a diagram representation of an implementation of an example garbage disposal assembly apparatus according to the present disclosure.

FIG. 4 illustrates a diagram representation of an implementation of an example garbage disposal assembly apparatus 400 according to the present disclosure. In some implementations, the garbage disposal assembly apparatus 400 comprises a top part 402, an elongated member 404, a handle 406, and a bracket or support member 408.

As shown in FIG. 4, in some implementations, the top part 402 may comprise a base or upper portion 402*a*, an extension or lower portion 402*b*, and an opening 402*c*.

In some implementations, the upper portion 402*a* is configured to extend at least partially over the top (e.g., the top side) of a sink flange 152 positioned or otherwise placed in a sink drain opening 182 as part of (e.g., during) a garbage disposal assembly 150 installation such as described above for FIG. 1.

In some implementations, the lower portion 402*b* is configured to extend from the upper portion 402*a* into the sink flange 152 placed in the sink drain opening 182 as part of the garbage disposal assembly 150 installation.

In some implementations, the top part 402 may have a semi-cylindrical shape. In some implementations, the top part 402 may have a semi-cylindrical cone shape. In some implementations, the top part 402 may have any other suitable shape.

As shown in FIG. 4, in some implementations, the opening 402*c* may extend partially into the top part 402, such as partially into the lower portion 402*b* on the opposite end of the top part 402 from the upper portion 402*a*. Alternately, in some implementations, the opening 402*c* of the top part 402 may extend through the top part 402, such as through the lower portion 402*b* and the upper portion 402*a*.

In some implementations, as described further below, the top part opening 402*c* may be configured to securely engage with the elongated member 404 at one or more positions along the elongated member 404.

In some implementations, the opening 402*c* may be configured to allow the elongated member 404 to attach or securely connect to the top part 402. For example, in some implementations, the opening 402*c* may be configured to allow the elongated member 404 to insert partially into the top part 402 while the elongated member 404 securely engages with the opening 402*c*.

Alternately, in some implementations, the opening 402*c* may be configured to allow the elongated member 404 to engagedly move or pass through (i.e., engagedly connect to) the top part 402. For example, in some implementations, the opening 402*c* may be configured to allow the elongated member 404 to move through the top part 402 while securely and movably engaged with the opening 402*c*.

As shown in FIG. 4, in some implementations, the top part 402 is configured to be placed on top of and at least partially into ("onto") the sink flange 152 of the garbage disposal assembly 150, such as during a garbage disposal assembly 150 installation.

In some implementations, the top part 402 is configured to apply pressure to the sink flange 152 through use of the garbage disposal assembly apparatus 400. In some implementations, the top part 402 is configured to apply such pressure to seal the sink flange 152 in the sink drain opening 182 for installation. In some implementations, the top part 402 is configured to apply such pressure to stabilize the sink flange 152 in the sink drain opening 182 for installation of other garbage disposal assembly components 151 to the sink 180.

In some implementations, such other garbage disposal assembly components 151 may comprise a fiber gasket 154, a backup flange 156, and/or a mounting ring 158, such as described above for FIG. 1. In some implementations, such other garbage disposal assembly components 151 may further comprise a snap ring 160, such as also described above for FIG. 1.

In some implementations, the elongated member 404 may comprise an elongated cylindrical bar. In some implementations, the elongated member 404 may comprise any other suitable elongated component.

In some implementations, the elongated member 404 may comprise a plurality of external screw threads (or "threads") extending at least partially along the elongated member 404. In some implementations, the elongated member 404 may comprise any other suitable engaging feature.

In some implementations, the elongated member 404 may be configured to connect or attach to the top part 402 in any suitable way. For example, in some implementations, the elongated member 404 may be configured to attach or securely connect to the top part 402 at or within the top part opening 402*c*.

Alternately, in some implementations, the elongated member 404 may be configured to engagedly move or pass through (i.e., engagedly connect to) the top part opening 402*c* in any suitable manner. For example, in some implementations, the elongated member 404 may be configured to engagedly move through the top part opening 402*c* in an upward or downward direction (e.g., linearly) with respect to the top part opening 402*c* through the top part 402.

In some implementations, the elongated member 404 may be configured to engagedly move through the handle opening 406*c* in any suitable manner. For example, in some implementations, the elongated member 404 may be configured to engagedly move through the handle opening 406*c* in an upward or downward direction (e.g., linearly) with respect to the handle opening 406*c* through the handle 406.

Alternately, in some implementations, the elongated member 404 may be configured to connect or attach to the handle 406 in any suitable way. For example, in some implementations, the elongated member 404 may be configured to attach or securely connect to the handle 406 at or within the handle opening 406*c*.

In some implementations, the elongated member 404 is configured to pass through the support member opening 408*c*. For example, in some implementations, the elongated member 404 may be configured to freely move in an upward or downward direction through the support member opening 408*c*.

As shown in FIG. 4, in some implementations, the handle 406 may comprise an opening 406*c*.

In some implementations, the handle 406 may have a rectangular prism shape. In some implementations, the handle 406 may have any other suitable shape.

In some implementations, the handle opening 406*c* may extend through the handle 406. Alternately, in some implementations, the opening 406*c* of the handle 406 may extend partially into the handle 406.

In some implementations, the handle opening 406*c* may be configured to securely engage with the elongated member 404 at one or more positions along the elongated member 404.

In some implementations, the opening 406*c* may be configured to allow the elongated member 404 to engagedly move or pass through the handle 406. For example, in some implementations, the opening 406*c* may be configured to allow the elongated member 404 to move through the handle 406 while securely and movably engaged with the opening 406*c*.

Alternately, in some implementations, the opening 402*c* may be configured to allow the elongated member 404 to connect or attach to the top part 402. For example, in some implementations, the opening 402*c* may be configured to allow the elongated member 404 to insert partially into the top part 402 while the elongated member 404 securely engages with the opening 402*c*.

In some implementations, the handle 406 may be configured to be hand moved by a user of the garbage disposal assembly apparatus 400, such as by an installer of a garbage disposal assembly 150. For example, in some implementations, the handle 406 may be configured to be hand turned by a user of the garbage disposal assembly apparatus 400.

In some implementations, the handle 406 may be configured to engagedly move in any suitable manner along the elongated member 404 passing through the handle opening 406*c*. For example, in some implementations, the handle 406 may be configured to engagedly move in an upward or downward direction (e.g., linearly) with respect to the handle opening 406*c* along the elongated member 404 passing through the handle opening 406*c*.

In some implementations, the handle 406 may be configured to engagedly move along the elongated member 404 in such manner by turning or otherwise moving the handle 406 with respect to the elongated member 404 passing through the handle opening 406*c*. For example, in some implementations, the handle 406 may be configured to engagedly move along the elongated member 404 in the upward direction by turning the handle 406 in a first direction around the elongated member 404 passing through the handle opening 406*c*. Similarly, in some implementations, the handle 406 may be configured to engagedly move along the elongated member 404 in the downward direction by turning the handle 406 in an opposite second direction around the elongated member 404 passing through the handle opening 406*c*.

As shown in FIG. 4, in some implementations, the handle 406 may be configured to engagedly move along the elongated member 404 in such manner while the elongated member 404 is connected or attached to the top part 402. In some implementations, the handle 406 may be configured to engagedly move along the elongated member 404 in such manner while the elongated member 404 passes through the support member opening 408*c*.

In some implementations, the handle 406 may be configured to engagedly move along the elongated member 404 in such manner while the elongated member 404 passes through the sink flange 152. In some implementations, the handle 406 may be configured to engagedly move along the elongated member 404 in such manner while the elongated member 404 passes through the other garbage disposal assembly components 151.

Alternately, in some implementations, the handle 406 may be configured to move the elongated member 404 in any suitable manner when the elongated member 404 is connected or attached to the handle 406. For example, in some implementations, the handle 406 may be configured to engagedly move the elongated member 404 through the top part opening 402*c* in an upward or downward direction (e.g., linearly) with respect to the top part opening 402*c*.

In some implementations, the handle 406 may be configured to engagedly move the elongated member 404 through the top part opening 402*c* in such manner by turning or otherwise moving the handle 406 with respect to the top part opening 402*c*. For example, in some implementations, the handle 406 may be configured to engagedly move the elongated member 404 through the top part opening 402*c* in the upward direction by turning the handle 406 in a first direction perpendicular to the top part opening 402*c*. Similarly, in some implementations, the handle 406 may be configured to engagedly move the elongated member 404 through the top part opening 402*c* in the downward direction by turning the handle 406 in an opposite second direction perpendicular to the top part opening 402*c*.

As shown in FIG. 4, in some implementations, the handle 406 may be configured to engagedly move the elongated member 404 in such manner while the elongated member 404 passes through the support member opening 408*c*.

In some implementations, the handle 406 may be configured to engagedly move the elongated member 404 in such manner while the elongated member 404 passes through the sink flange 152. In some implementations, the handle 406 may be configured to engagedly move the elongated member 404 in such manner while the elongated member 404 passes through the other garbage disposal assembly components 151.

In some implementations, as described further below, the handle 406 is configured to press against the support member 408 when the garbage disposal assembly apparatus 400 is used to install a garbage disposal assembly 150.

As shown in FIG. 4, in some implementations, the support member 408 may comprise a base 408*a*, a first leg 408*b*1, a second leg 408*b*2, and an opening 408*c*.

In some implementations, the support member 408 may have a 'U' shape or horseshoe shape formed by the base 408*a* and the legs 408*b*1, 408*b*2. For example, in some implementations, the legs 408*b*1, 408*b*2 may extend respectively from each end of the base 408*a* to form a 'U' or horseshoe shaped support member 408. In some implementations, the support member 408 may have any other suitable shape.

In some implementations, the opening 408*c* of the support member 408 extends through the base 408*a*. In some implementations, the support member opening 408*c* extends through the base 408*a* in a direction that is substantially parallel to the extension of the legs 408*b*1, 408*b*2 from the base 408*a*. In some implementations, the opening 408*c* has any other suitable configuration.

In some implementations, the support member opening 408*c* is configured to allow the elongated member 404 to pass through the support member 408. For example, in some implementations, the support member opening 408*c* may be configured to allow the elongated member 404 to freely move in an upward or downward direction through the support member opening 408*c*.

In some implementations, as described further below, the support member 408 may be configured so that the ends 408*f*1, 408*f*2 of the legs 408*b*1, 408*b*2, opposite the extension of the legs 408*b*1, 408*b*2 from the base 408*a*, press against the bottom 180*a* of a sink 180 when the garbage disposal assembly apparatus 400 is used to install a garbage disposal assembly 150. In some implementations, the support member 408 is configured to thereby allow the garbage disposal assembly apparatus 400 to apply pressure to a sink flange 152, by the top part 402 as described above, during a garbage disposal assembly 150 installation.

Figure 2A:
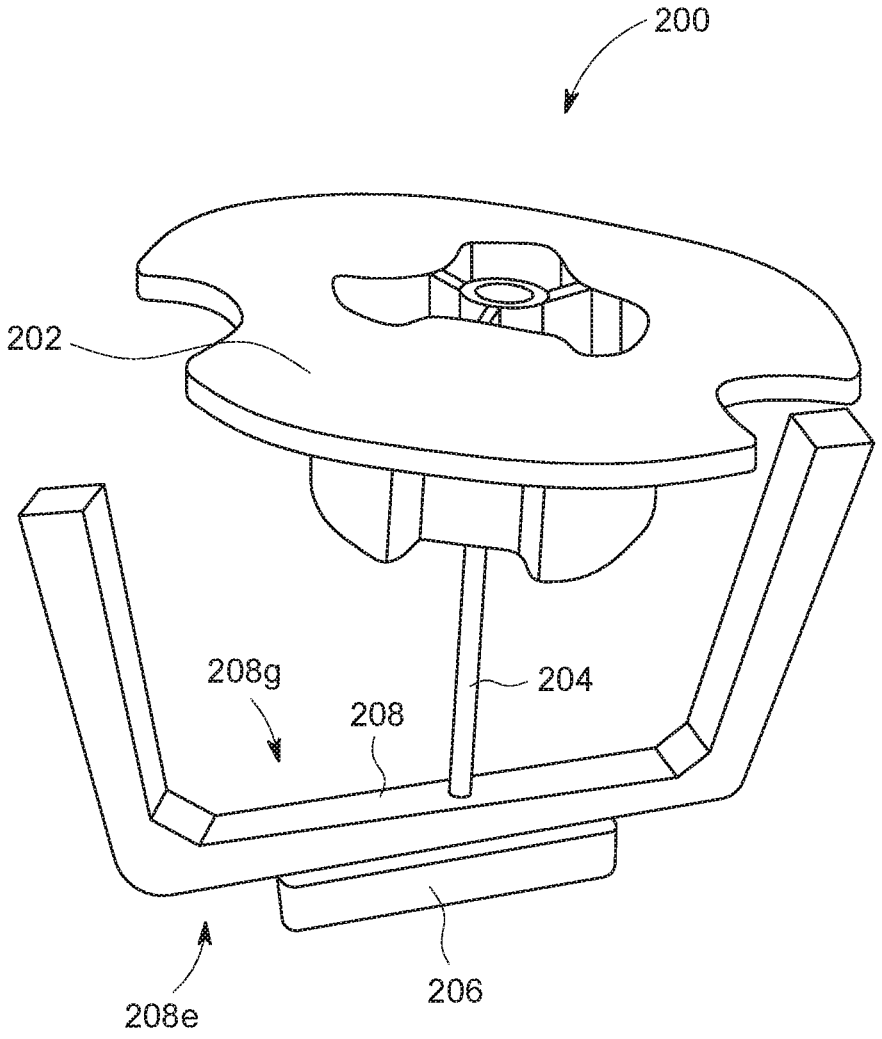
FIG. 2A illustrates an implementation of an example garbage disposal assembly apparatus according to the present disclosure.

FIG. 2A illustrates an implementation of an example garbage disposal assembly apparatus 200 according to the present disclosure. FIG. 2F illustrates another view of the garbage disposal assembly apparatus 200 shown in FIG. 2A.

As shown in FIGS. 2A and 2F, in some implementations, the garbage disposal assembly apparatus 200 comprises a top part 202, a threaded bolt or rod ("threaded rod") 204, a handle 206, and a brace or bracket ("bracket") 208.

In some implementations, the garbage disposal assembly apparatus 200, which is described below with respect to FIGS. 2A-2F and 3A-3C, is similar to the garbage disposal assembly apparatus 400 described above for FIG. 4. For example, in some implementations, the top part 202, threaded rod 204, handle 206, and bracket 208 of the garbage disposal assembly apparatus 200 are similar respectively to the top part 402, elongated member 404, handle 406, and support member 408 of the garbage disposal assembly apparatus 400, but may further comprise other features described below with respect to FIGS. 2A-2F and 3A-3C.

Figure 3A:
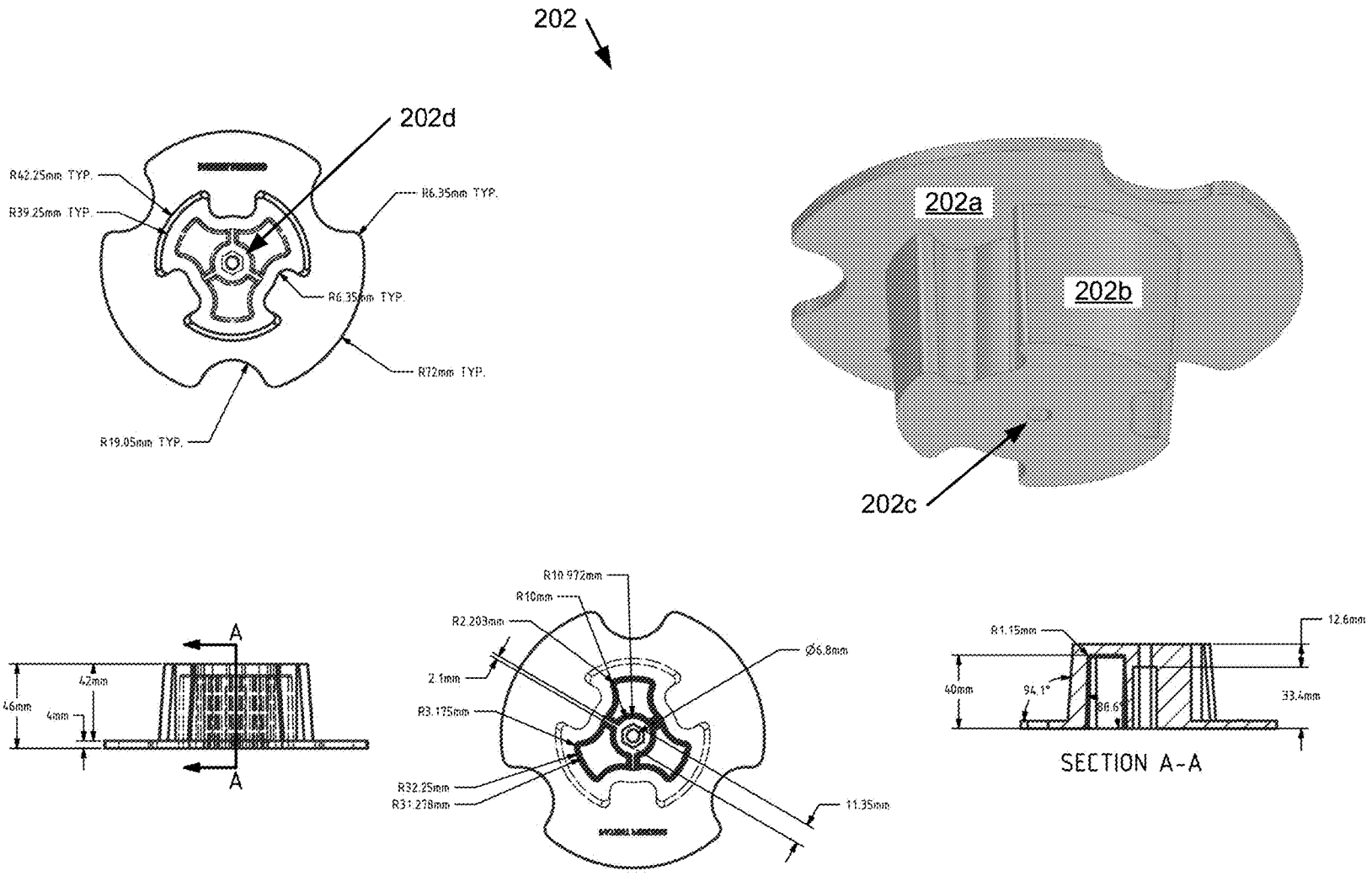
FIGS. 3A-3C illustrate various manufacturing or production representations of the top part, handle, and bracket, respectively, of the garbage disposal assembly apparatus of FIG. 2A.

FIG. 3A illustrates various manufacturing or production representations of the top part 202 of the garbage disposal assembly apparatus 200. As shown in FIG. 3A, in some implementations, the top part 202 comprises an upper portion or base 202*a*, a lower portion or extension 202*b*, and an opening 202*c*.

In some implementations, the base 202*a* has a semi-circular shape. In some implementations, the base 202*a* has a semi-circular disc shape. In some implementations, the base 202*a* has any other suitable shape.

In some implementations, the base 202*a* is configured to extend at least partially over the top (e.g., the top side) of a sink flange 152 placed in a sink drain opening 182 as part of (e.g., during) a garbage disposal assembly 150 installation such as described above for FIG. 1.

In some implementations, the extension 202*b* of the top part 202 extends from the base 202*a*.

In some implementations, the extension 202*b* has a semi-cylindrical shape. In some implementations, the extension 202*b* has a semi-cylindrical cone shape. In some implementations, the extension 202*b* has any other suitable shape.

In some implementations, the extension 202*b* is configured to extend into the sink flange 152 placed in the sink drain opening 182 as part of the garbage disposal assembly 150 installation.

In some implementations, the extension 202*b* is of sufficient height to extend through the top opening of the sink flange 152 and at least partially into the sink flange 152. In some implementations, the extension 202*b* is of sufficient height to extend through the top and the bottom opening of the sink flange 152.

As shown in FIG. 3A, in some implementations, the opening 202*c* of the top part 202 extends through the base 202*a* and the extension 202*b*. Alternately, in some implementations, the opening 202*c* extends partially into the extension 202*b* on the opposite end of the top part 202 from the base 202*a*.

In some implementations, the opening 202*c* is elongated. In some implementations, the opening 202*c* is linear. In some implementations, the opening 202*c* has any other suitable configuration.

In some implementations, the opening 202*c* comprises internal screw threads (or "threads") extending at least partially along the opening 202*c*. In some implementations, the internal screw threads of the opening 202*c* are formed in the surface of the opening 202*c*.

In some implementations, the internal screw threads of the opening 202*c* are provided by a nut 202*d* (e.g., a hardware nut, nut fastener, locknut, etc.) attached within the opening 202*c*. In some implementations, the internal screw threads of the opening 202*c* are provided in any other suitable manner.

In some implementations, as described further below, the internal screw threads of the opening 202*c* are configured to mate with external screw threads of the threaded rod 204. In some implementations, the internal screw threads of the opening 202*c* are configured to rotatingly engage with the external screw threads (or "threads") of the threaded rod 204.

In some implementations, as described further below, the opening 202*c* is configured to allow the threaded rod 204 to pass through the top part 202. For example, in some implementations, the opening 202*c* is configured to allow the threaded rod 204 to pass through the top part 202 while the threaded rod 204 rotatingly engages with the opening 202*c*.

Alternately, in some implementations, the opening 202*c* is configured to allow the threaded rod 204 to insert partially into the top part 202 while the threaded rod 204 rotatingly engages with the opening 202*c*. In some implementations, the opening 202*c* is configured to thereby allow the threaded rod 204 to connect or attach to the top part 202 by the internal screw threads or in any other suitable manner.

In some implementations, the threaded rod 204 and the top part 202 may be attached together to form a single, threaded rod component.

Figure 2B:
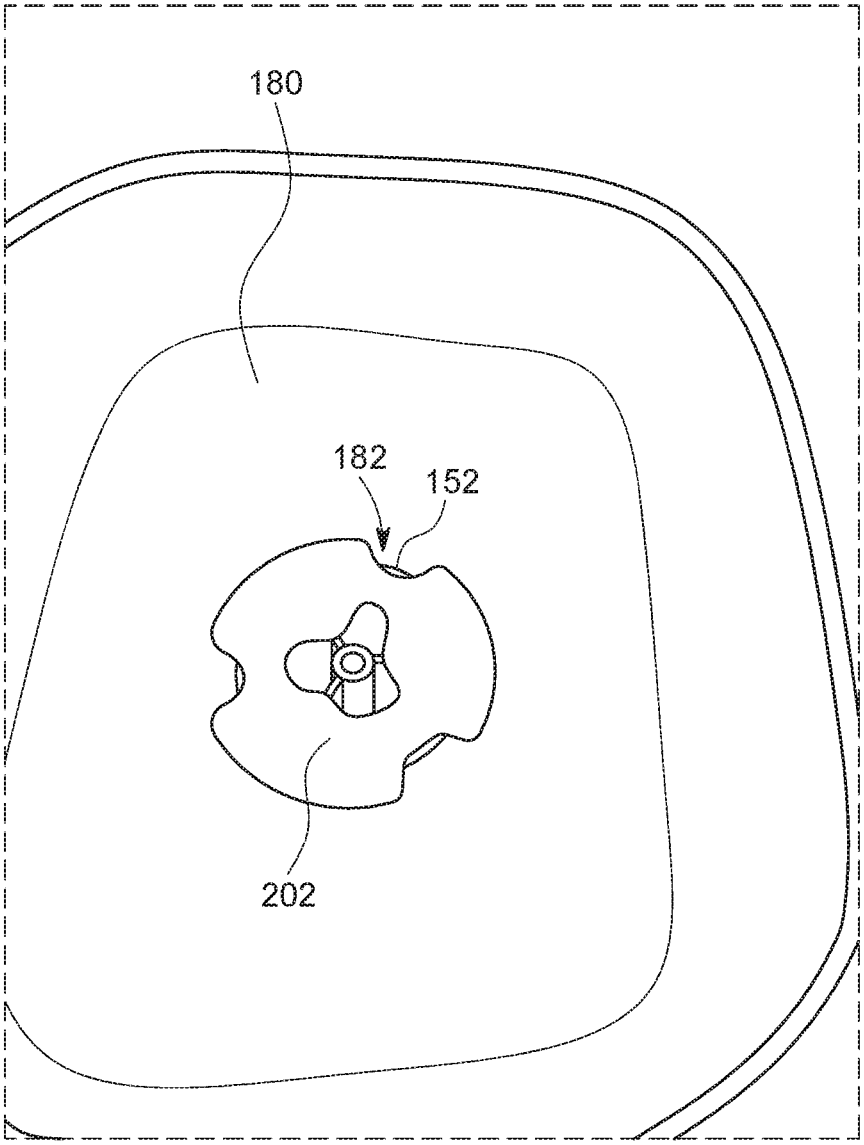
FIGS. 2B-2F illustrate other views and an example use of the garbage disposal assembly apparatus of FIG. 2A according to the present disclosure.
Figure 2C:
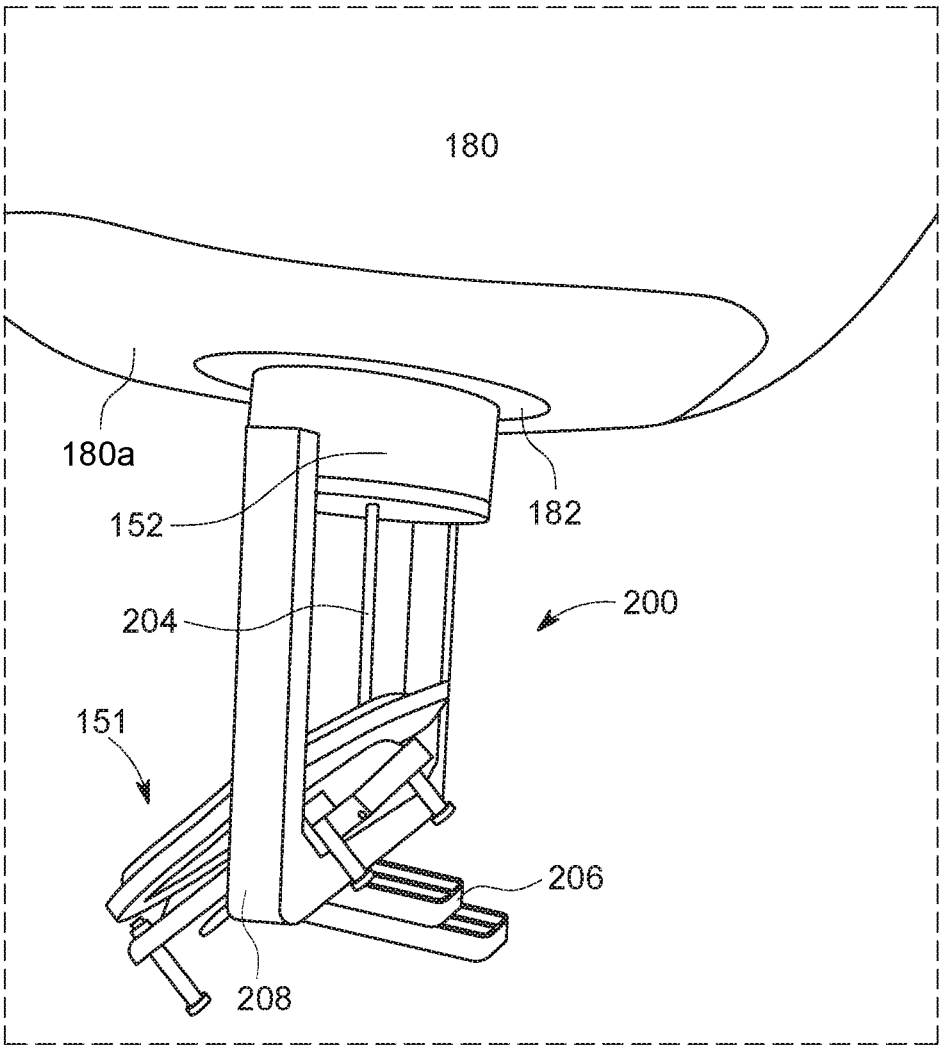

FIG. 2B illustrates another view of the top part 202 of the garbage disposal assembly apparatus 200. As shown in FIG. 2B, in some implementations, the top part 202 is configured to be placed on top of and at least partially into ("onto") the sink flange 152 of the garbage disposal assembly 150. In some implementations, the top part 202 is configured to be placed onto the sink flange 152 while the sink flange 152 is positioned or otherwise placed in the sink drain opening 182 as part of a garbage disposal assembly 150 installation.

In some implementations, as described further below, the top part 202 is configured to apply pressure to the sink flange 152 through use of the garbage disposal assembly apparatus 200. For example, in some implementations, the top part 202 is configured to apply pressure to the sink flange 152 for sealing of the sink flange 152 in the sink drain opening 182. In some implementations, the top part 202 is configured to apply pressure to the sink flange 152 to stabilize the sink flange 152 in the sink drain opening 182 for installation of other garbage disposal assembly 150 components to the sink 180.

As shown in FIGS. 2A and 2F, in some implementations, the threaded rod 204 of the garbage disposal assembly apparatus 200 comprises an elongated bar and a plurality of external screw threads (or "threads").

In some implementations, the threaded rod 204 comprises a cylindrical elongated bar. In some implementations, the threaded rod 204 comprises an elongated bar of any other suitable shape.

In some implementations, the threaded rod 204 comprises a plurality of external screw threads extending along the elongated bar. For example, in some implementations, the threaded rod 204 is a piece of all-thread material. In some implementations, the threaded rod 204 is a fully threaded stud bolt. In some implementations, the threaded rod 204 is any other suitable fully threaded elongated bar.

In some implementations, the threaded rod 204 comprises a plurality of external screw threads extending at least partially from one or both ends of the elongated bar towards the opposite end respectively of the elongated bar. For example, in some implementations, the threaded rod 204 is a tap end or a double end threaded stud bolt. In some implementations, the threaded rod 204 is any other suitable partially threaded elongated bar.

In some implementations, the external screw threads of the threaded rod 204 are configured to mate with the internal screw threads of the top part opening 202*c*. In some implementations, the external screw threads of the threaded rod 204 are configured to rotatingly engage with the internal screw threads of the top part opening 202*c*.

In some implementations, as described further below, the threaded rod 204 is configured to move through the top part opening 202*c* in a screw rotation manner. For example, in some implementations, the threaded rod 204 is configured to linearly move through the top part opening 202*c* in one direction when the threaded rod 204 is rotated in a first direction. In some implementations, the threaded rod 204 is configured to linearly move through the top part opening 202*c* in the other direction when the threaded rod 204 is rotated in the opposite direction.

Alternately, in some implementations, the threaded rod 204 is configured to connect or attach to the top part 202 at or within the top part opening 202*c*. For example, in some implementations, the threaded rod 204 is configured to thread or screw into the top part opening 202*c*. In some implementations, the threaded rod 204 is configured to connect or attach to the top part 202 in any other suitable way.

In some implementations, as described further below, the threaded rod 204 is configured to connect or attach to the handle 206. For example, in some implementations, the threaded rod 204 is configured to attach to the handle 206 in the handle opening 206*c*. In some implementations, the threaded rod 204 is configured to rotatingly engage with the handle opening 206*c* to connect to the handle 206.

In some implementations, the threaded rod 204 is configured to connect or attach to the handle 206 in any other suitable manner.

In some implementations, the threaded rod 204 and the handle 206 are attached together to form a single, threaded rod component with a T-handle configuration.

Alternately, in some implementations, the external screw threads of the threaded rod 204 are configured to mate with internal screw threads of the handle opening 206*c*. In some implementations, the external screw threads of the threaded rod 204 are configured to rotatingly engage with the internal screw threads of the handle opening 206*c*.

In some implementations, the threaded rod 204 may be configured to move through the handle opening 206*c* in a screw rotation manner. For example, in some implementations, the threaded rod 204 may be configured to linearly move through the handle opening 206*c* in one direction when the threaded rod 204 is rotated in a first direction. In some implementations, the threaded rod 204 may be configured to linearly move through the handle opening 206*c* in the other direction when the threaded rod 204 is rotated in the opposite direction.

In some implementations, as described further below, the threaded rod 204 is configured to pass through the bracket opening 208*c*.

In some implementations, the threaded rod 204 is alternately a threaded bolt, a screw, or similar fastener ("threaded fastener") that comprises the same or substantially similar above-described features of the threaded rod 204 and further comprises a bolt or screw head (not shown). In some implementations, the bolt or screw head is configured to be contained within the handle opening 206*c*. In some implementations, the bolt or screw head is configured to be connected or attached to the handle 206 within the handle opening 206*c*.

In some implementations, the threaded fastener alternative of the threaded rod 204 functions the same or substantially similar to the threaded rod 204 as described further below.

Figure 3B:
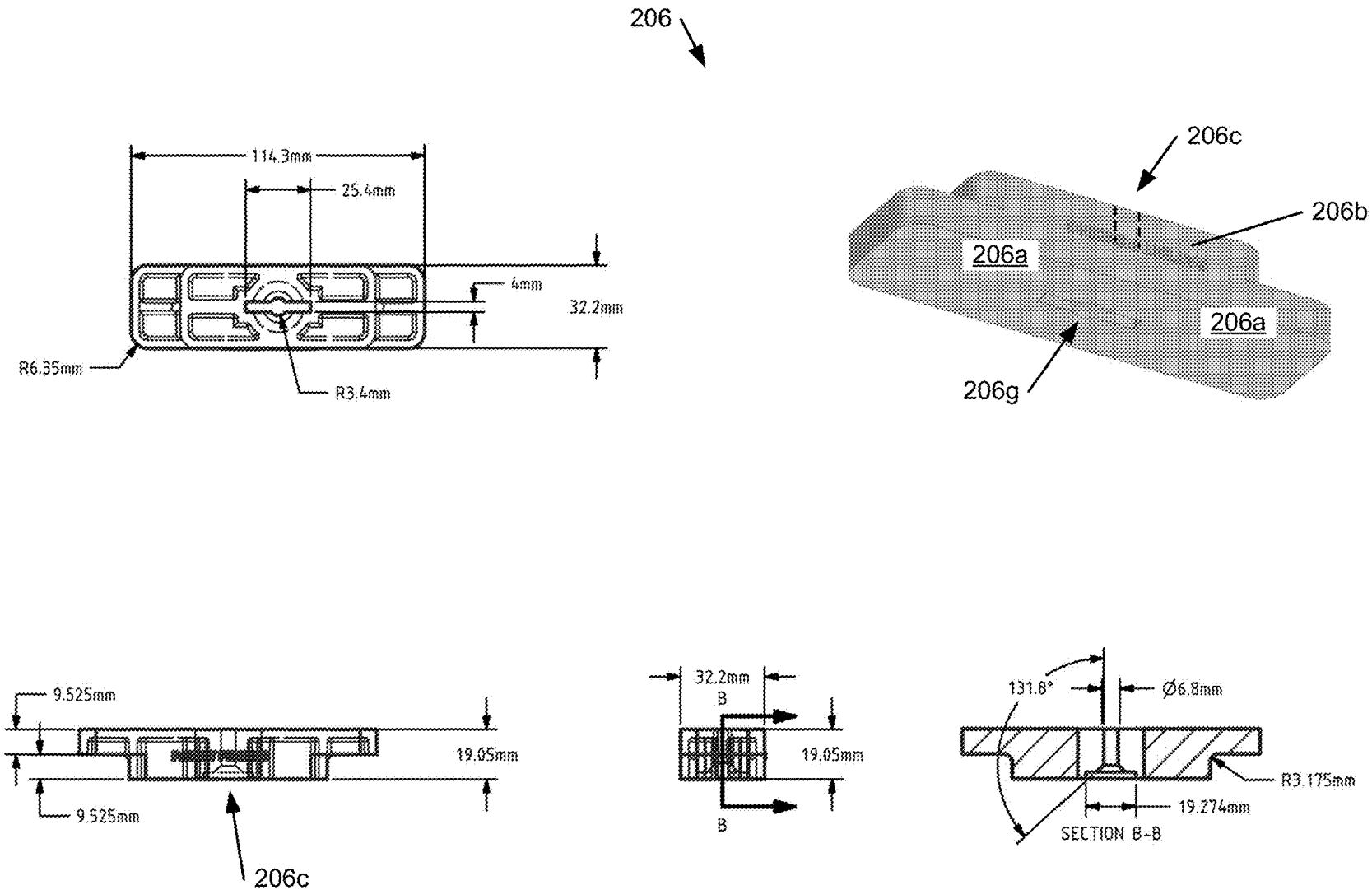

FIG. 3B illustrates various manufacturing or production representations of the handle 206 of the garbage disposal assembly apparatus 200. As shown in FIG. 3B, in some implementations, the handle 206 comprises a base 206*a*, a body 206*b*, and an opening 206*c*. In some implementations, the handle 206 further comprises a slot 206*g*.

As shown in FIG. 3B, in some implementations, the base 206*a* has a rectangular prism shape. In some implementations, the base 206*a* has any other suitable shape.

As shown in FIG. 3B, in some implementations, the body 206*b* extends from the base 206*a*.

In some implementations, the body 206*b* has a rectangular prism shape that is similar to the shape of the base 206*a*. For example, in some implementations, the length of the body 206*b* is less than the length of the base 206*a*. In some implementations, the body 206*b* has any other suitable shape.

As shown in FIG. 3B, in some implementations, the opening 206*c* of the handle 206 extends partially into the handle 206. For example, in some implementations, the opening 206*c* extends at least partially into the handle body 206*b*. Alternately, in some implementations, the opening 206*c* extends through the handle 206, including through the base 206*a* and the body 206*b*. In some implementations, the opening 206*c* is thereby configured to allow the threaded rod 204 to pass through the handle 206, such as while rotatingly engaging the internal threads of the opening as described below.

In some implementations, the opening 206*c* may have any other suitable structure.

In some implementations, the opening 206*c* comprises internal screw threads. In some implementations, the internal screw threads of the opening 206*c* are the same or similar to the internal screw threads of the top part opening 202*c* described above.

In some implementations, the internal screw threads of the opening 206*c* are configured to mate with external screw threads of the threaded rod 204. In some implementations, the internal screw threads of the opening 206*c* are configured to rotatingly engage with external screw threads of the threaded rod 204.

As shown in FIG. 3B, in some implementations, the slot 206*g* of the handle 206 extends at least partially into the handle 206. For example, as shown in FIG. 3B, in some implementations, the slot 206*g* extends at least partially into the base 206*a* on the opposite side from the extension of the body 206*b* from the base 206*a*. In some implementations, the slot 206*g* has any other suitable structure.

In some implementations, the slot 206*g* is configured to receive a apparatus in the slot 206*g* for turning or assisting to turn the handle 206. For example, in some implementations, the slot 206*g* is configured to receive a screwdriver head into the slot 206*g*. In some implementations, the slot 206*g* is configured to receive any other suitable apparatus in the slot 206*g*.

In some implementations, the slot 206*g* is configured to allow the turning of the above-described threaded fastener configuration of the threaded rod 204 by a apparatus such as screwdriver. In some implementations, the slot 206*g* is configured to allow the turning of the threaded fastener 204 by any other suitable apparatus.

Figure 2D:
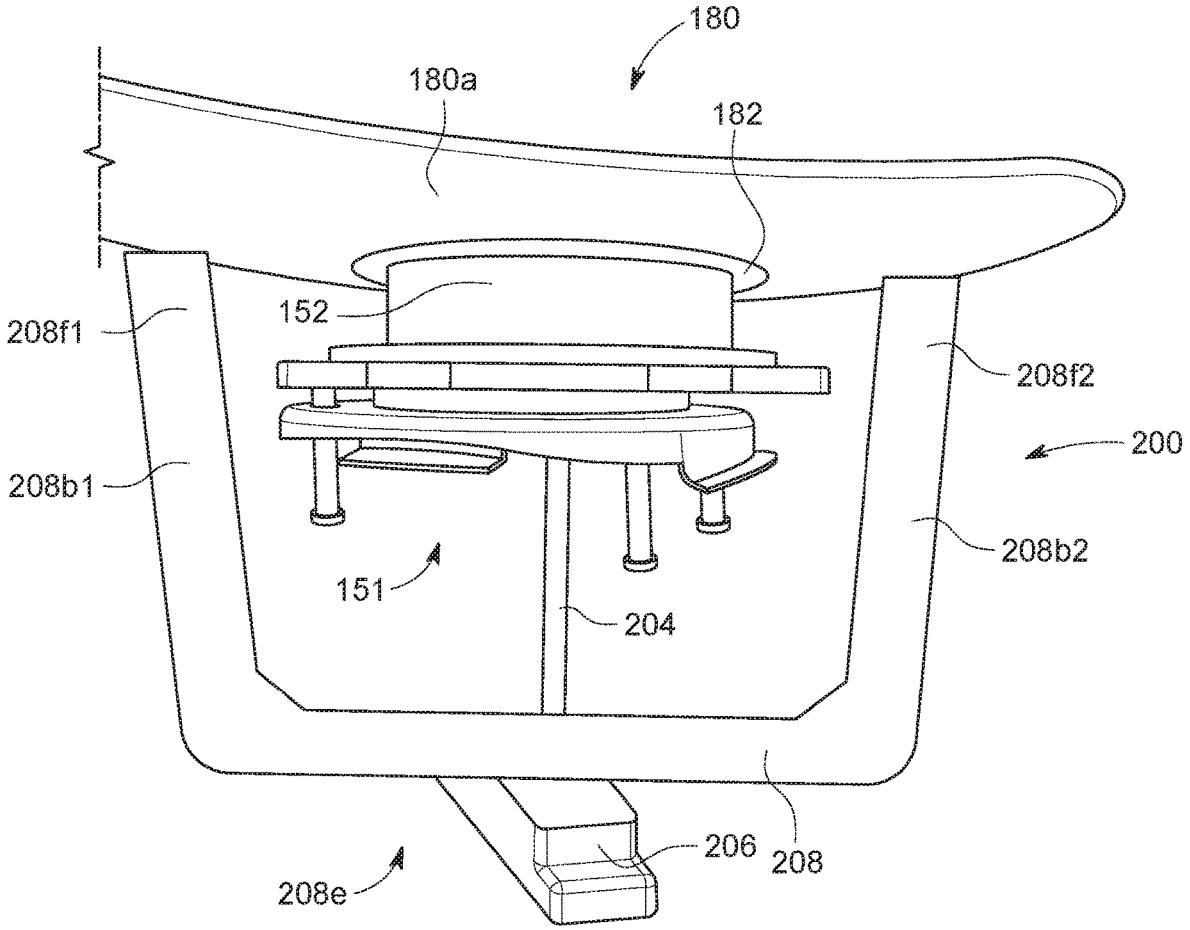

FIG. 2D illustrates another view of the garbage disposal assembly apparatus 200 including of the handle 206. As shown in FIG. 2D, in some implementations, the handle 206 is configured to allow the threaded rod 204 to be connected or attached to the handle 206 in the handle opening 206*c*. For example, in some implementations, the handle 206 is configured to allow the threaded rod 204 to be rotatingly engaged with the handle opening 206*c* to securely connect the threaded rod 204 to the handle 206.

In some implementations, the handle 206 is configured to allow the threaded rod 204 to be securely connected to the handle opening 206*c* by the rotating engagement of the screw threads of the threaded rod 204 and the handle opening 206*c* respectively. In some implementations, the handle 206 is configured to allow the threaded rod 204 to be connected or attached to the handle opening 206*c* in any other suitable manner.

In some implementations, the handle 206 is configured to be hand turned by a user of the garbage disposal assembly apparatus 200. In some implementations, the user is an installer of a garbage disposal assembly 150.

In some implementations, the handle 206 is configured to rotate the connected or attached threaded rod 204. In some implementations, the handle 206 is configured to rotate the threaded rod 204 when the handle 206 is turned by the user of the garbage disposal assembly apparatus 200.

Figure 2E:
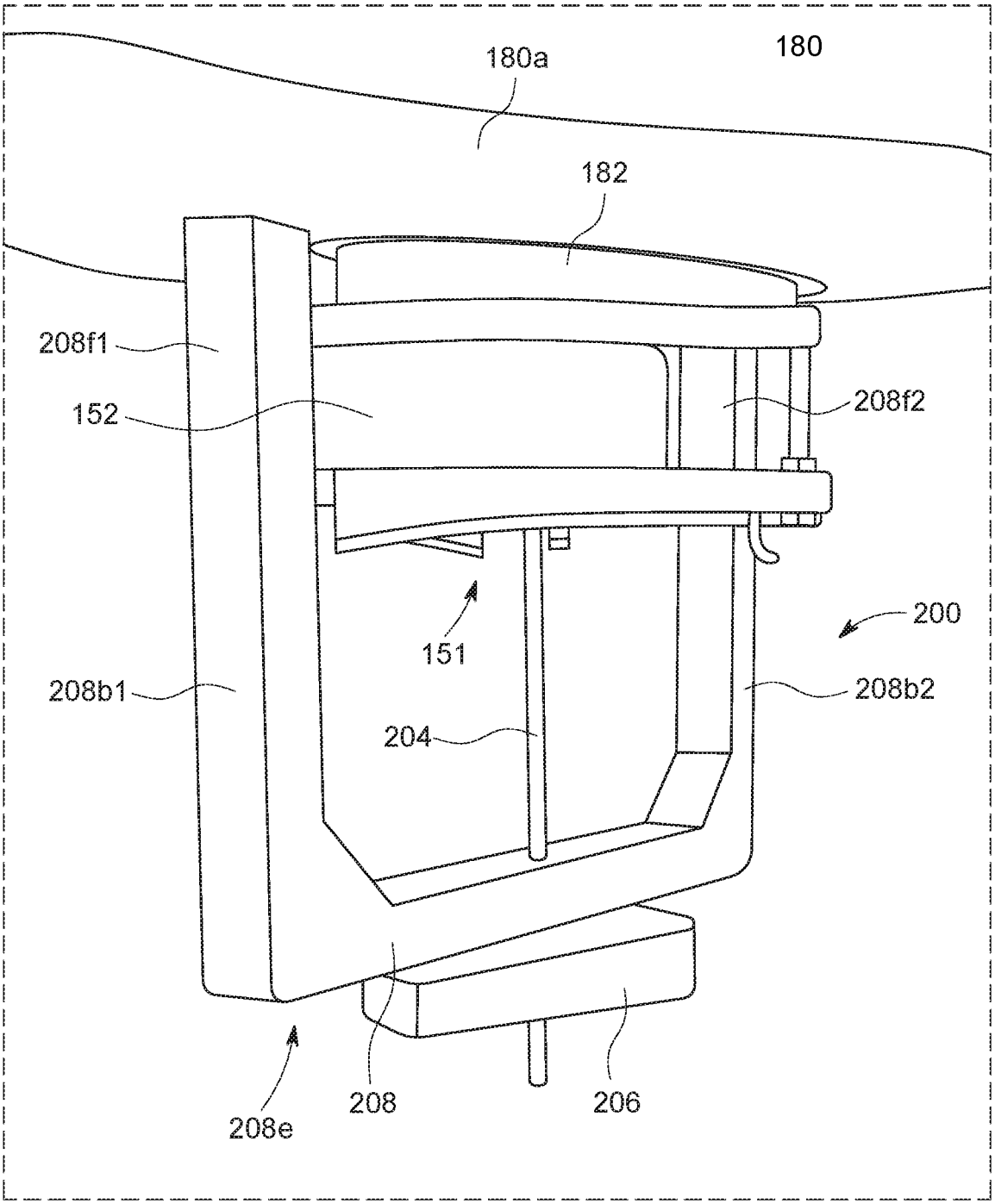
Figure 2F:
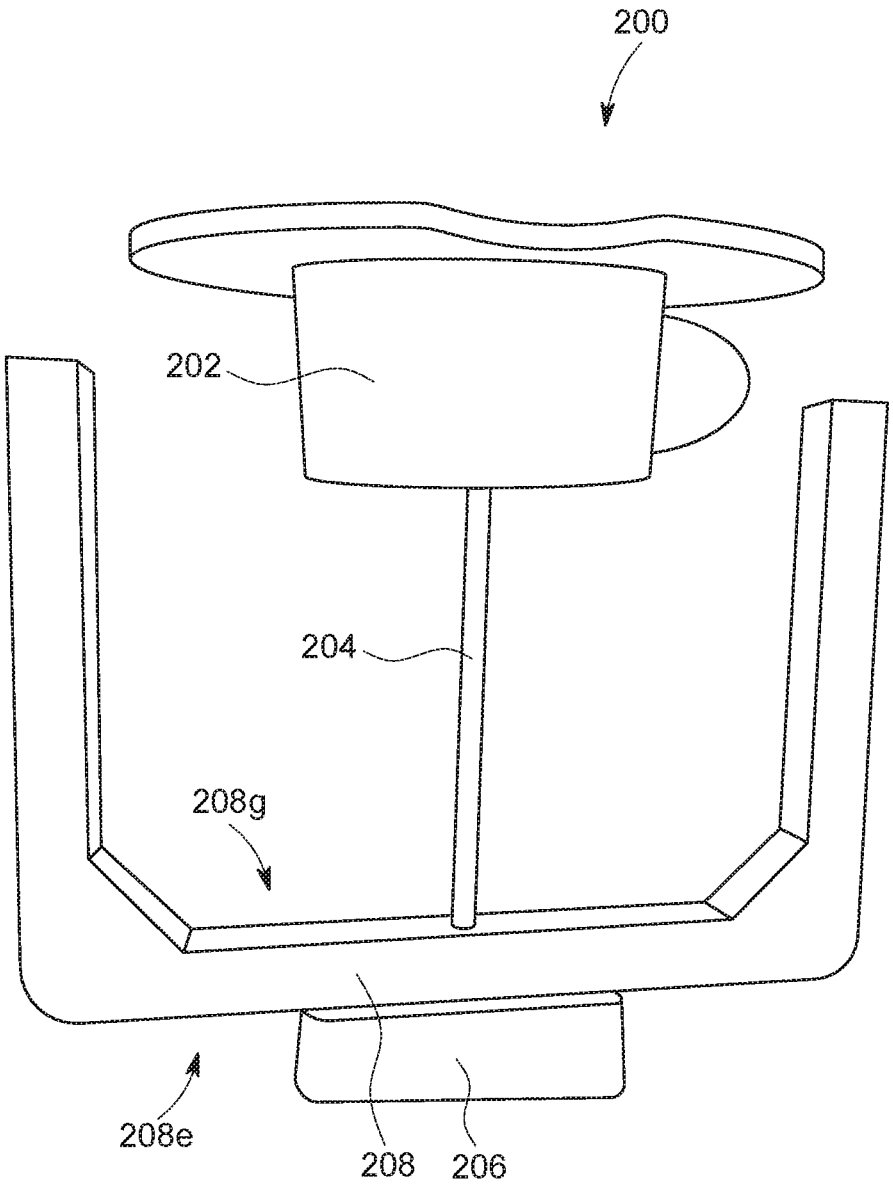

FIG. 2E illustrates an alternate other view of the garbage disposal assembly apparatus 200 including of the handle 206. As shown in FIG. 2E, in some implementations, the handle 206 may be configured to move along the threaded rod 204 passing through the handle opening 206*c* in a screw rotation manner. For example, in some implementations, the handle 206 may be configured to linearly move along the threaded rod 204 passing through the handle opening 206*c* in one direction when the handle 206 is rotated in a first direction. In some implementations, the handle 206 may be configured to linearly move along the threaded rod 204 passing through the handle opening 206*c* in the other direction when the handle 206 is rotated in the opposite direction.

In some implementations, as described further below, the handle 206 is configured to press against the bracket 208 when the garbage disposal assembly apparatus 200 is used to install a garbage disposal assembly 150.

Figure 3C:
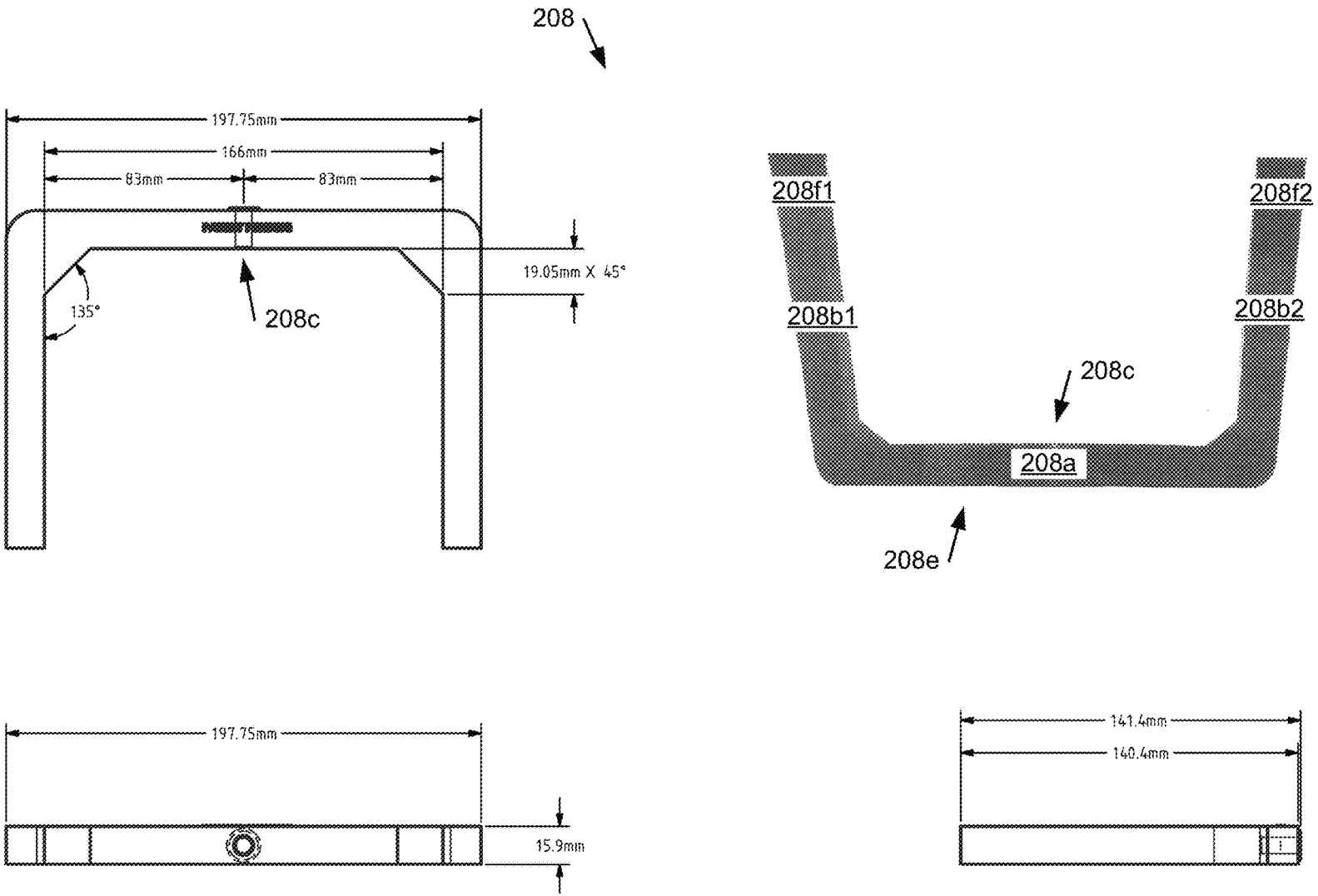

FIG. 3C illustrates various manufacturing or production representations of the bracket 208 of the garbage disposal assembly apparatus 200. As shown in FIG. 3C, in some implementations, the bracket 208 comprises a base 208*a*, a first leg 208*b*1, a second leg 208*b*2, and an opening 208*c*.

As shown in FIG. 3C, in some implementations, the bracket 208 has a 'U' shape or horseshoe shape formed by the base 208*a* and the legs 208*b*1, 208*b*2. For example, in some implementations, the legs 208*b*1, 208*b*2 extend respectively from each end of the base 208*a* to form the 'U' or horseshoe shaped bracket 208. In some implementations, the bracket 208 has any other suitable shape.

In some implementations, the base 208*a* and the legs 208*b*1, 208*b*2 each have a rectangular prism shape. In some implementations, the base 208*a* and the legs 208*b*1, 208*b*2 each have any other suitable shape.

As shown in FIG. 3C, in some implementations, the opening 208*c* of the bracket 208 extends through the base 208*a*. In some implementations, the bracket opening 208*c* extends through the base 208*a* in a direction that is substantially parallel to the extension of the legs 208*b*1, 208*b*2 from the base 208*a*. In some implementations, the opening 208*c* has any other suitable structure.

FIGS. 2D and 2E illustrate another view of the garbage disposal assembly apparatus 200 including of the bracket 208. As shown in FIGS. 2D and 2E, in some implementations, the bracket opening 208*c* is configured to allow the threaded rod 204 to pass through the bracket 208.

In some implementations, as described further below, the bracket 208 is configured so that the ends 208f1, 208f2 of the legs 208*b*1, 208*b*2 press against the bottom 180*a* of a sink 180 when the garbage disposal assembly apparatus 200 is used to install a garbage disposal assembly 150. In some implementations, the bracket 208 is configured to thereby allow the garbage disposal assembly apparatus 200 to apply pressure to a sink flange 152 during a garbage disposal assembly 150 installation.

As shown in FIGS. 2B and 4 respectively, in some implementations, the garbage disposal assembly apparatus 200, 400 is configured to hold a sink flange 152 of a garbage disposal assembly 150 firmly in place in a sink drain opening 182. In some implementations, the garbage disposal assembly apparatus 200, 400 is configured to hold the sink flange 152 by the top part 202, 402 applying pressure to the sink flange 152 during a garbage disposal assembly 150 installation.

In some implementations, the garbage disposal assembly apparatus 200, 400 is configured to apply pressure on top of the sink flange 152 installed in the sink drain opening 182. In some implementations, the garbage disposal assembly apparatus 200, 400 is configured to apply sufficient, even pressure to the sink flange 152.

In some implementations, the garbage disposal assembly apparatus 200, 400 is configured to apply pressure to the sink flange 152 for sealing of the sink flange 152 in the sink drain opening 182.

In some implementations, the garbage disposal assembly apparatus 200, 400 is configured to apply pressure to allow plumber's putty applied to the sink flange 152 to form a water-tight seal of the sink flange 152 to the sink 180.

In some implementations, the garbage disposal assembly apparatus 200, 400 is configured to apply pressure to the sink flange 152 to stabilize the sink flange 152 for installation of other garbage disposal assembly components 151 to the sink 180.

In some implementations, the garbage disposal assembly apparatus 200, 400 is configured to apply pressure to the sink flange 152 without the use of a weighted object which may scratch or otherwise cause damage to the sink 180.

In some implementations, the garbage disposal assembly apparatus 200, 400 is configured to apply pressure to the sink flange 152 without the use of manual pressure applied by an installer.

As shown in FIG. 2C, which illustrates another view of the garbage disposal assembly apparatus 200, and respectively in FIG. 4, in some implementations, the garbage disposal assembly apparatus 200, 400 is configured to hold other garbage disposal assembly components 151 under the sink 180. For example, in some implementations, the garbage disposal assembly apparatus 200, 400 is configured to hold a fiber gasket 154, a backup flange 156, a mounting ring 158, and/or a snap ring 160 under the sink 180.

In some implementations, the garbage disposal assembly apparatus 200, 400 is configured to hold the other garbage disposal assembly components 151 under the sink 180 to be installed at the sink drain opening 182.

As shown in FIG. 4 and described further below, in some implementations, the garbage disposal assembly apparatus 400 is configured to hold the other garbage disposal assembly components 151 under the sink 180 by the elongated member 404 of the garbage disposal assembly apparatus 400.

As shown in FIG. 2C and described further below, in some implementations, the garbage disposal assembly apparatus 200 is configured to hold the other garbage disposal assembly components 151 under the sink 180 by the threaded rod 204 of the garbage disposal assembly apparatus 200.

In some implementations, the garbage disposal assembly apparatus 200, 400 is configured to apply pressure to the sink flange 152 above the sink 180 so that a second installer is not required to install the other garbage disposal assembly 150 components under the sink 180 as described above for FIG. 1.

In some implementations, the garbage disposal assembly apparatus 200, 400 is configured to allow a single installer to perform a garbage disposal assembly 150 installation while applying pressure to the sink flange 152 using the garbage disposal assembly apparatus 200.

In some implementations, the garbage disposal assembly apparatus 200, 400 is configured to eliminate the need to use a weighted object or an additional installer to properly install a garbage disposal assembly 150. In some implementations, the garbage disposal assembly apparatus 200, 400 is configured to eliminate such need by applying pressure to the sink flange 152 above the sink 180 and holding the other garbage disposal assembly components 151 under the sink 180 as described above.

In some implementations, the garbage disposal assembly apparatus 200, 400 comprises any suitable dimensions, such as the example dimensions shown in FIGS. 3A-3C.

In some implementations, the garbage disposal assembly apparatus 200, 400 is composed of any suitable materials. For example, in some implementations, the top part 202, 402, the handle 206, 406, and the bracket 208, 408 may be composed of a plastic material. In some implementations, the elongated member 404 or the threaded rod 204 may be composed of a metal material.

In some implementations, the garbage disposal assembly apparatus 200, 400 can have any suitable appearance, such as the example appearance shown in FIGS. 2A-2F.

As shown in FIG. 4, in some implementations, an example method of use of the garbage disposal assembly apparatus 400 comprises securely connecting the top part 402 and the elongated member 404 together by partially inserting the elongated member 404 into the top part 402 so that the elongated member 404 securely engages with the opening 402*c* of the top part 402.

In some implementations, the method comprises placing the top part 402 on top of and at least partially into the sink flange 152 that is placed in the sink drain opening 182 by inserting the elongated member 404 connected to the top part 402 through the sink flange 152 and partially inserting the lower portion 402*b* of the top part 402 into the sink flange 152.

In some implementations, the method comprises securing the other garbage disposal assembly components 151 to the garbage disposal assembly apparatus 400 by inserting the elongated member 404 through an opening of each of the other garbage disposal assembly components 151.

In some implementations, the method comprises inserting the elongated member 404 through the opening 408*c* of the support member 408.

In some implementations, the method comprises engagedly connecting the handle 406 to the elongated member 404 by inserting the elongated member 404 into the opening 406*c* of the handle 406 to securely and movably engage the elongated member 404 with the opening 406*c* of the handle 406.

In some implementations, the method comprises moving the handle 406 upward along the elongated member 404 to engage the support member 408 to the sink bottom 180*a* and thereby apply downward pressure against the sink flange 152. In some implementations, the handle 406 is moved upward along the elongated member 404 by moving the handle 406 with respect to the elongated member 404 passing through the opening 406*c* of the handle 406.

As shown in FIG. 4, in some implementations, an alternate example method of use of the garbage disposal assembly apparatus 400 comprises securely connecting the handle 406 and the elongated member 404 together by partially inserting the elongated member 404 into the handle 406 so that the elongated member 404 securely engages with the opening 4046*c* of the handle 406.

In some implementations, the method comprises placing the top part 402 on top of and at least partially into the sink flange 152 that is placed in the sink drain opening 182 by partially inserting the lower portion 402*b* of the top part 402 into the sink flange 152.

In some implementations, the method comprises inserting the elongated member 404 connected to the handle 406 through the opening 408*c* of the support member 408.

In some implementations, the method comprises securing the other garbage disposal assembly components 151 to the garbage disposal assembly apparatus 400 by inserting the elongated member 404 through an opening of each of the other garbage disposal assembly components 151.

In some implementations, the method comprises engagedly connecting the elongated member 404 to the top part 402 by inserting the elongated member 404 into the opening 402*c* of the top part 402 to securely and movably engage the elongated member 404 with the opening 402*c* of the top part 402.

In some implementations, the method comprises moving the elongated member 404 upward through the opening 402*c* of the top part 402 to engage the support member 408 to the sink bottom 180*a* and thereby apply downward pressure against the sink flange 152. In some implementations, the elongated member 404 is moved through the opening 402*c* of the top part 402 by moving the handle 406 with respect to the opening 402*c* of the top part 402.

As shown in FIG. 2B, in some implementations, an example method of use of the garbage disposal assembly apparatus 200 comprises placing the top part 202*a* on top of and at least partially into ("onto") a sink flange 152 of a garbage disposal assembly 150.

In some implementations, the top part 202 is positioned or otherwise placed onto the sink flange 152 (i.e., from above the sink 180) while the sink flange 152 is placed in a sink drain opening 182 as part of (e.g., during) a garbage disposal assembly 150 installation. For example, in some implementations, the sink flange 152 includes plumber's putty applied to the sink flange 152. In some implementations, the plumber's putty is for sealing of the sink flange 152 in the sink drain opening 182 as part of the garbage disposal assembly 150 installation.

As shown for example in FIGS. 2A and 2F, in some implementations, the method comprises securely connecting the threaded rod 204 and the handle 206 together.

In some implementations, securely connecting the threaded rod 204 and the handle 206 together comprises rotatingly engaging the screw threads of the threaded rod 204 and the handle opening 206*c* respectively. For example, in some implementations, the threaded rod 204 is screwed into the handle opening 206*c* to securely connect the threaded rod 204 and the handle 206 together. Alternately, in some implementations, the handle opening 206*c* is screwed onto the threaded rod 204 to securely connect the threaded rod 204 and the handle 206 together.

In some implementations, the threaded rod 204 and the handle 206 are previously securely connected or otherwise attached together prior to using the garbage disposal assembly apparatus 200 for a garbage disposal assembly 150 installation. For example, in some implementations, the threaded rod 204 and the handle 206 are previously attached together to form a single, threaded rod component with a T-handle configuration.

In some implementations, the threaded rod 204 and the handle 206 are securely connected or otherwise attached together before placing the top part 202 onto the sink flange 152 while the sink flange 152 is placed in a sink drain opening 182 as part of a garbage disposal assembly 150 installation as described above.

Alternately, in some implementations, the method comprises securely connecting the threaded rod 204 and the top part 202 together. .In some implementations, securely connecting the threaded rod 204 and the top part 202 together comprises rotatingly engaging the screw threads of the threaded rod 204 and the top part opening 202*c* respectively. For example, in some implementations, the threaded rod 204 is screwed into the top part opening 202*c* to securely connect the threaded rod 204 and the top part 202 together. Alternately, in some implementations, the top part opening 202*c* is screwed onto the threaded rod 204 to securely connect the threaded rod 204 and the top part 202 together.

In some implementations, the threaded rod 204 and the top part 202 are previously securely connected or otherwise attached together prior to using the garbage disposal assembly apparatus 200 for a garbage disposal assembly 150 installation. For example, in some implementations, the threaded rod 204 and the top part 202 are previously attached together to form a single, threaded rod component.

In some implementations, the threaded rod 204 and the top part 202 are securely connected or otherwise attached together before placing the top part 202 onto the sink flange 152 while the sink flange 152 is placed in a sink drain opening 182 as part of a garbage disposal assembly 150 installation as described above. In some implementations, such as when the threaded rod 204 and the top part 202 are previously securely connected or otherwise attached together, the threaded rod 204 is placed through the sink flange 152 (i.e., from above the sink 180) while the sink flange 152 is placed in the sink drain opening 182 as the top part 202 is placed onto the sink flange 152

As shown for example in FIGS. 2A and 2F, in some implementations, the method comprises inserting the threaded rod 204, which is securely connected to the handle 206, through the bracket opening 208*c*. In some implementations, the threaded rod 204 is inserted through the bracket opening 208*c* with the bracket 208 positioned in a 'U' shaped orientation. In some implementations, the bracket legs 208*b*1, 208*b*2 extend vertically upward from the bracket base 208*a* with the bracket 208 positioned in the 'U' shaped orientation.

As shown in FIGS. 2A and 2F, in some implementations, the threaded rod 204 is inserted through the bracket opening 208*c* from a bottom side 208*e* of the bracket 208. In some implementations, the threaded rod 204 is inserted through the bracket opening 208*c* from the bracket bottom side 208*e* so that the connected handle 206 is positioned adjacent to the bracket bottom side 208*e*.

As shown in FIGS. 2A and 2F, in some implementations, the threaded rod 204 is inserted through the bracket opening 208*c* from the bracket bottom side 208*e* so that the threaded rod 204 extends upward through the bracket opening 208*c* in between and substantially parallel to the bracket legs 208*b*1, 208*b*2.

In some implementations, the threaded rod 204, securely connected to the handle 206, is previously inserted through the bracket opening 208*c*, as described above. In some implementations, the threaded rod 204 is previously inserted through the bracket opening 208*c* prior to using the garbage disposal assembly apparatus 200 for a garbage disposal assembly 150 installation.

Alternately, in some implementations, the method comprises inserting the threaded rod 204, which is securely connected to the top part 202, through the bracket opening 208*c*. In some implementations, the threaded rod 204 is inserted through the bracket opening 208*c* with the bracket 208 positioned in a 'U' shaped orientation, such as described above.

As shown in FIGS. 2A and 2F, in some implementations, the threaded rod 204 is inserted through the bracket opening 208*c* from a top side 208*g* (i.e., opposite the bottom side 208*e*) of the bracket 208. In some implementations, the threaded rod 204 is inserted through the bracket opening 208*c* from the bracket top side 208*g* so that the connected top part 202 is positioned adjacent to the bracket top side 208*g*.

As shown in FIGS. 2A and 2F, in some implementations, the threaded rod 204 is inserted through the bracket opening 208*c* from the bracket top side 208*g* so that the threaded rod 204 extends downward through the bracket opening 208*c* in between and substantially parallel to the bracket legs 208*b*1, 208*b*2.

In some implementations, the threaded rod 204, securely connected to the top part 202, is previously inserted through the bracket opening 208*c*, as described above. In some implementations, the threaded rod 204 is previously inserted through the bracket opening 208*c* prior to using the garbage disposal assembly apparatus 200 for a garbage disposal assembly 150 installation.

As shown in FIG. 2C, in some implementations, the method comprises securing the components of the garbage disposal assembly 150, other than the sink flange 152, (the "other components 151") to the garbage disposal assembly apparatus 200. In some implementations, the other components 151 comprise a fiber gasket 154, a backup flange 156, and/or a mounting ring 158, such as described above for FIG. 1. In some implementations, the other components 151 further comprise a snap ring 160, such as also described above for FIG. 1.

As shown in FIG. 2C, in some implementations, the other components 151 are secured so that the components 151 can be held by the garbage disposal assembly apparatus 200 under the sink 180 for installation at the sink drain opening 182.

In some implementations, the other components 151 are secured to the garbage disposal assembly apparatus 200 by the threaded rod 204. In some implementations, the other components 151 are secured to the garbage disposal assembly apparatus 200 by inserting or otherwise placing the threaded rod 204 through the respective openings of the other components 151. In some implementations, the other components 151 are thereby placed around the threaded rod 204.

In some implementations, the other components 151 are placed around the threaded rod 204 so that the other components 151 are positioned on top of the bracket base 208*a* between the bracket legs 208*b*1, 208*b*2.

In some implementations, such as when the threaded rod 204 is connected to the top part 202, the other components 151 are secured to the garbage disposal assembly apparatus 200 by the threaded rod 204, as described above, before the threaded rod 204 is inserted through the bracket opening 208*c* as described above.

As shown in FIG. 2C, in some implementations, the method comprises engagedly connecting the threaded rod 204 to the top part 202, with the handle 206, the bracket 208, and the other components 151 placed on the threaded rod 204 as described above. In some implementations, as described above, the top part 202 is inserted in the sink drain opening 182 from above the sink 180.

In some implementations, engagedly connecting the threaded rod 204 to the top part 202 comprises rotatingly engaging the screw threads of the threaded rod 204 and the top part opening 202*c* respectively. For example, in some implementations, the threaded rod 204 is screwed into the top part opening 202*c* to rotatingly engage the threaded rod 204 and the top part 202. In some implementations, the threaded rod 204 is rotatingly engaged with the top part 202 through the sink drain opening 182 from under the sink 180.

In some implementations, the threaded rod 204 is screwed into the top part opening 202*c* by turning the securely connected handle 206 to thereby rotate the threaded rod 204. In some implementations, turning the handle 206 thereby rotatingly engages the respective threads of the threaded rod 204 and the top part opening 202*c*.

In some implementations, the rotatingly engaged threaded rod 204 can be moved through the top part opening 202*c* in a screw rotation manner. For example, in some implementations, the threaded rod 204 can be moved upward through the top part opening 202*c* when the threaded rod 204 is rotated in a right-handed clockwise direction. Similarly, in some implementations, the threaded rod 204 can be moved downward through the top part opening 202*c* when the threaded rod 204 is rotated in a right-handed counter-clockwise direction.

In some implementations, the rotatingly engaged threaded rod 204 can be moved through the top part opening 202*c* in any other suitable screw rotation manner.

Alternately, in some implementations, the method comprises engagedly connecting the handle 206 to the threaded rod 204 with the top part 202, the other components 151, and the bracket 208 placed on the threaded rod 204 as described above. In some implementations, as described above, the handle 206 is screwed onto the threaded rod 204 below the bottom side 208*e* of the bracket 208.

In some implementations, engagedly connecting the handle 206 to the threaded rod 204 comprises rotatingly engaging the screw threads of the handle opening 206*c* and the threaded rod 204 respectively. For example, in some implementations, the handle opening 206*c* is screwed onto the threaded rod 204 to rotatingly engage the handle 206 and the threaded rod 204. In some implementations, the handle 206 is rotatingly engaged with the threaded rod 204 securely connected or attached to the top part 202 and inserted through the sink drain opening 182 (e.g., including through the sink flange 152) from above the sink 180.

In some implementations, the handle 206 is screwed onto the threaded rod 204 by turning the handle 206 to thereby rotatingly engage the threaded rod 204. In some implementations, turning the handle 206 thereby rotatingly engages the respective threads of the handle opening 206*c* and the threaded rod 204.

In some implementations, the rotatingly engaged handle 206 can be moved along the threaded rod 204 in a screw rotation manner. For example, in some implementations, the handle 206 can be moved upward along the threaded rod 204 when the handle 206 is rotated in a right-handed clockwise direction. Similarly, in some implementations, the handle 206 can be moved along the threaded rod 204 when the handle 206 is rotated in a right-handed counter-clockwise direction.

In some implementations, the rotatingly engaged handle 206 can be moved along the threaded rod 204 in any other suitable screw rotation manner.

As shown in FIG. 2D, in some implementations, the method comprises moving the threaded rod 204 upward through the top part opening 202*c* to engage the bracket 208 to the sink bottom 180*a*. In some implementations, engaging the bracket 208 to the sink bottom 180*a* thereby causes the top part 202 to apply downward pressure against the sink flange 152.

In some implementations, the threaded rod 204 is moved upward through the top part opening 202*c* by turning the handle 206 securely connected or attached to the threaded rod 204 as described above.

Alternately, as shown in FIG. 2E, in some implementations, the method comprises moving the handle 206 upward along the threaded rod 204, securely connected or attached to the top part 202, to engage the bracket 208 to the sink bottom 180*a*. In some implementations, engaging the bracket 208 to the sink bottom 180*a* thereby causes the top part 202 to apply downward pressure against the sink flange 152.

In some implementations, the handle 206 is moved upward along the threaded rod 204 by turning the handle 206 around the threaded rod 204 passing through the handle opening 206 as described above.

As shown in FIGS. 2D and 2E, in some implementations, moving the threaded rod 204 upward through the top part opening 202*c*, or downward through the handle 206, thereby moves the bracket 208 toward the sink bottom 108*a*. In some implementations, the bracket 208 is moved toward the sink bottom 108*a* by the handle 206 pushing up the bracket 208 from the bracket bottom side 208*a* as the threaded rod 204 is moved upward through the top part opening 202*c* or downward through the handle 206.

As shown in FIGS. 2D and 2E, in some implementations, the bracket 208 is engaged to the sink bottom 180*a* by the ends 208*f*1, 208*f*2 of the bracket legs 208*b*1, 208*b*2 being pressed against the sink bottom 180*a* as the bracket 208 is moved toward the sink bottom 108*a*.

In some implementations, when the bracket 208 is engaged to the sink bottom 180*a* and the threaded rod 204 is further moved upward through the top part opening 202*c*, the threaded rod 204 thereby pulls downward on the top part 202. In some implementations, the threaded rod 204 pulls downward on the top part 202 through the engagement of the threads of the threaded rod 204 and the top part opening 202*c*.

Alternately, in some implementations, when the bracket 208 is engaged to the sink bottom 180*a* and the handle 206 is further moved upward along the threaded rod 204, the threaded rod 204 thereby pulls downward on the top part 202. In some implementations, the threaded rod 204 pulls downward on the top part 202 through the secure connection or attachment of the threaded rod 204 and the top part 202.

In some implementations, the threaded rod 204 pulling downward on the top part 202 thereby causes the top part 202 to apply pressure to the sink flange 152. In some implementations, the top part 202 thereby applies pressure downward on the sink flange 152.

In some implementations, the threaded rod 204 is moved upward or downward through the top part opening 202*c* to thereby adjust the pressure applied by the top part 202 to the sink flange 152. For example, in some implementations, moving the threaded rod 204 upward or downward through the top part opening 202*c* increases or decreases respectively the pressure applied by the top part 202 to the sink flange 152.

Alternately, in some implementations, the handle 206 is moved upward or downward along the threaded rod 204 to thereby adjust the pressure applied by the top part 202 to the sink flange 152. For example, in some implementations, moving the handle 206 upward or downward along the threaded rod 204 increases or decreases respectively the pressure applied by the top part 202 to the sink flange 152.

In some implementations, the pressure applied by the top part 202 is adjusted to an appropriate amount for the proper installation of the sink flange 152 and the other components 151 of the garbage disposal assembly 150.

In some implementations, the pressure applied to the sink flange 152 by the top part 202 holds the sink flange 152 firmly in place in the sink drain opening 182.

In some implementations, the pressure applied to the sink flange 152 by the top part 202 is a sufficient, even pressure on top of the sink flange 152.

In some implementations, the pressure applied to the sink flange 152 by the top part 202 is for sealing of the sink flange 152 in the sink drain opening 182.

In some implementations, the pressure applied to the sink flange 152 by the top part 202 allows plumber's putty applied to the sink flange 152 to form a water-tight seal of the sink flange 152 to the sink 180.

In some implementations, the pressure applied to the sink flange 152 by the top part 202 stabilizes the sink flange 152 for installation of the other garbage disposal assembly components 151 to the sink 180.

In some implementations, the method further comprises installing the other components 151 to the sink 180 after using the garbage disposal assembly apparatus 200 as described above. In some implementations, the other components 151 can be installed to the sink 180 by moving the other components 151 up to the sink drain opening 182 along the threaded rod 204.

In some implementations, the other components 151 can be installed to the sink 180 by a single installer while the garbage disposal assembly apparatus 200 applies pressure to and stabilizes the sink flange 152 in the sink drain opening 182.

In some implementations, the method further comprises removing the garbage disposal assembly apparatus 200 from the sink 180 after installing the other components 151 to complete the installation of the garbage disposal assembly 150. In some implementations, removing the garbage disposal assembly apparatus 200 from the sink 180 comprises disconnecting the threaded rod 204 from the top part 202 and removing the top part 202 from the sink flange 152 in the sink drain opening 182.

In some implementations, disconnecting the threaded rod 204 from the top part 202 comprises rotatingly disengaging the threads of the threaded rod 204 and the top part opening 202*c* respectively. For example, in some implementations, the threaded rod 204 is unscrewed out of the top part opening 202*c* to rotatingly disengage the threaded rod 204 and the top part 202.

In some implementations, the threaded rod 204 is unscrewed out of the top part opening 202*c* by turning the securely connected handle 206 to thereby rotate the threaded rod 204. For example, in some implementations, the threaded rod 204 is rotated in a right-handed counter-clockwise direction to unscrew the threaded rod 204 out of the top part opening 202*c*.

Alternately, in some implementations, removing the garbage disposal assembly apparatus 200 from the sink 180 comprises disconnecting the handle 206 from the threaded rod 204 and removing the top part 202 from the sink flange 152 in the sink drain opening 182.

In some implementations, disconnecting the handle 206 from the threaded rod 204 comprises rotatingly disengaging the threads of the handle opening 206*c* and the threaded rod 204 respectively. For example, in some implementations, the handle 206 is unscrewed off of the threaded rod 204 to rotatingly disengage the handle 206 and the threaded rod 204.

In some implementations, the handle 206 is screwed off of the threaded rod 204 by turning the handle 206 around the threaded rod 204 passing through the handle opening 206 to thereby rotate the handle 206. For example, in some implementations, the handle 206 is rotated in a right-handed counter-clockwise direction to unscrew the handle 206 off of the threaded rod 204.

In some implementations, a garbage disposal 170 can be installed to the garbage disposal assembly 150, such as described above for FIG. 1, after the garbage disposal assembly apparatus 200 is removed from the sink 180.

The figures, including photographs and drawings, comprised herewith may represent one or more implementations of the garbage disposal assembly apparatus.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A garbage disposal assembly apparatus, comprising a top part, an elongated member, a handle, and a support member, wherein:

the top part comprises an upper portion, a lower portion, and an opening, wherein:

the upper portion is configured to extend over the top of a sink flange of a garbage disposal assembly placed in a sink drain opening as part of an installation of the garbage disposal assembly to a sink, wherein the garbage disposal assembly comprises the sink flange, a fiber gasket, a backup flange, and a mounting ring;

the lower portion is configured to extend from the upper portion into the sink flange;

the opening of the top part extends partially into the lower portion on the opposite end of the top part from the upper portion;

the opening of the top part is configured to allow the elongated member to insert partially into the top part while the elongated member securely engages with the opening of the top part;

the top part is configured to be placed on top of and partially into the sink flange of the garbage disposal assembly during the garbage disposal assembly installation;

the top part is configured to apply pressure to the sink flange to seal the sink flange in the sink drain opening for installation;

the top part is configured to apply pressure to the sink flange to stabilize the sink flange in the sink drain opening for installation of other garbage disposal assembly components, wherein the other garbage disposal assembly components comprise the fiber gasket, the backup flange, and the mounting ring;

the elongated member comprises an elongated bar;

the elongated member is configured to securely connect to the top part within the opening of the top part;

the handle comprises an opening, wherein:

the opening extends through the handle;

the opening is configured to allow the elongated member to engagedly move through the handle, wherein the handle is thereby configured to allow the elongated member to move through the opening of the handle while securely and movably engaged with the opening of the handle;

the elongated member is configured to engagedly move through the opening of the handle in an upward direction or a downward direction with respect to the opening through the handle;

the handle is configured to be hand moved by a user of the garbage disposal assembly apparatus;

the handle is configured to engagedly move in the upward direction or the downward direction with respect to the opening of the handle along the elongated member passing through the opening of the handle by moving the handle with respect to the elongated member passing through the opening of the handle;

the handle is configured to press against the support member when the handle is moved in the upward direction along the elongated member passing through the opening of the handle;

the handle is configured to engagedly move along the elongated member while the elongated member is securely connected to the top part and the elongated member passes through the sink flange, each of the other garbage disposal assembly components, and the support member;

the support member comprises a base, a total of two legs including a first leg and a second leg, and an opening, wherein:

the support member has a U-shape formed by the first leg and the second leg extending respectively from each end of the base;

the opening extends through the base in a direction parallel to the first leg and the second leg extending from the base; and the opening of the support member is configured to allow the elongated member to pass through the support member;

the elongated member is configured to pass through the opening of the support member; and the support member is configured so that the end of the first leg and the second leg respectively, the base, engages the bottom of the sink when the handle presses in the upward direction against the support member, whereby the top part is pulled in the downward direction by the elongated member thereby applying pressure on the sink flange.

2. The garbage disposal assembly apparatus of claim 1, wherein:

the handle is configured to engagedly move along the elongated member in the upward direction by turning the handle in a first direction around the elongated member passing through the opening of the handle; and the handle is configured to engagedly move along the elongated member in the downward direction by turning the handle in an opposite second direction around the elongated member passing through the opening of the handle.

3. The garbage disposal assembly apparatus of claim 1, wherein:

the elongated member comprises a cylindrical elongated bar having a plurality of external screw threads extending along the cylindrical elongated bar;

the opening of the top part comprises a plurality of internal screw threads configured to securely engage with the external screw threads of the elongated member; and the opening of the handle comprises a plurality of internal screw threads configured to securely engage with the external screw threads of the elongated member.

4. A method of using the garbage disposal assembly apparatus of claim 1, comprising:

securely connecting the top part and the elongated member together by partially inserting the elongated member into the top part so that the elongated member securely engages with the opening of the top part;

placing the top part on top of and at least partially into the sink flange that is placed in the sink drain opening by inserting the elongated member connected to the top part through the sink flange and partially inserting the lower portion of the top part into the sink flange;

securing the other garbage disposal assembly components to the garbage disposal assembly apparatus by inserting the elongated member through an opening of each of the other garbage disposal assembly components;

inserting the elongated member through the opening of the support member; engagedly connecting the handle to the elongated member by inserting the elongated member into the opening of the handle to securely and movably engage the elongated member with the opening of the handle; and moving the handle upward along the elongated member to engage the support member to the sink bottom and thereby apply downward pressure against the sink flange, wherein the handle is moved upward along the elongated member by moving the handle with respect to the elongated member passing through the opening of the handle.

5. The method of claim 4, further comprising installing the other components of the garbage disposal assembly that are secured to the garbage disposal assembly apparatus by the elongated member.

6. A garbage disposal assembly apparatus, comprising a top part, an elongated member, a handle, and a support member, wherein:

the top part comprises an upper portion, a lower portion, and an opening, wherein:

the upper portion comprises a flat piece of material having a first surface and an opposite second surface, and having an outermost edge sized such that, when the top part is inserted into a sink flange of a garbage disposal assembly that is placed in a sink drain opening as part of an installation of the garbage disposal assembly to a sink, the upper portion extends beyond the outermost edge of the top of the sink flange and the second surface rests flat against the top of the sink flange;

the lower portion comprises a piece of material having side walls extending from the second surface of the upper portion to a bottom surface of the top part;

the opening of the top part extends from the bottom surface of the top part at least partially through the top part toward the first surface of the upper portion; the elongated member comprises an elongated bar having a first end and a second end, wherein the first end is configured to insert into the opening in the top part;

the handle comprises a piece of material configured to be handled by a user and having a handle opening that extends at least partially into the handle, wherein the handle opening is configured to allow the second end of the elongated member to insert into the handle opening;

the support member comprises a base, a total of two legs including a first leg and a second leg, and an opening, wherein:

the base, the first leg, and the second leg each comprise an elongated piece of material;

the support member has a U-shape formed by the first leg and the second leg extending respectively from each end of the base;

the opening extends through the base;

the opening of the support member is configured to allow the elongated member to pass through the support member; and the support member is configured so that the end of the first leg and the second leg respectively, opposite the base, engages the bottom of the sink when the handle presses in an upward direction against the support member.

7. A method of using the garbage disposal assembly apparatus of claim 6, comprising:

placing the top part on top of and at least partially into the sink flange that is placed in the sink drain opening;

inserting the elongated member into the top part such that the elongated member extends from the top part into the sink flange within the sink drain opening and extends therefrom to below the sink;

inserting the elongated member through an opening of one or more other garbage disposal assembly components to be attached to the sink flange;

inserting the elongated member through the opening of the support member;

engaging the end of the first leg and the second leg respectively, opposite the base, of the support member with the bottom of the sink; and inserting the elongated member into the opening of the handle.

8. The method of claim 7, further comprising moving the handle along the elongated member inserted into the opening of the handle, whereby the handle moves the support member against the sink bottom and the top part is thereby moved by the elongated member inserted into the opening of the top part and thereby applies pressure against the sink flange by the upper portion of the top part toward the sink drain opening to seal the sink flange in the sink drain opening for installing the sink flange and to stabilize the positioning of the sink flange in the sink drain opening by the upper portion and the lower portion of the top part for installation of the one or more other garbage disposal assembly components.

9. The method of claim 7, further comprising moving the elongated member within the opening of the top part by moving the handle, whereby the handle moves the support member against the sink bottom and the top part moves along the elongated member inserted into the opening of the top part and thereby applies pressure against the sink flange by the upper portion of the top part toward the sink drain opening to seal the sink flange in the sink drain opening for installing the sink flange and to stabilize the positioning of the sink flange in the sink drain opening by the upper portion and the lower portion of the top part for installation of the one or more other garbage disposal assembly components.

10. A garbage disposal assembly apparatus for use with a garbage disposal assembly and a sink; the sink comprising a sink top surface, a sink bottom surface and a sink opening extending from the sink top surface to the sink bottom surface;

the garbage disposal assembly apparatus comprising:

a top part adapted to engage with the sink top surface;

a support member including a base, a support member opening, and a total of two legs including a first leg and a second leg, each leg extending from the base and adapted to engage with the sink bottom surface;

a handle; and an elongated member including a first end portion configured with the top part and a second end portion configured with the handle, and adapted to extend through the sink opening and the support member opening;

wherein the handle, when turned, is adapted to cause the top part to move downward along the elongated member and/or to cause the support member to move upward along the elongated member.

11. The garbage disposal assembly apparatus of claim 10 wherein the base includes a first end and a second end, and the first leg extends from the base's first end and the second leg extends from the base's second end.

12. The garbage disposal assembly apparatus of claim 11 wherein the first end is located opposite to the second end.

13. The garbage disposal assembly apparatus of claim 11 wherein the support member opening is located between the first end and the second end.

* * * * *